US011387540B2

(12) United States Patent
Kolokotronis

(10) Patent No.: US 11,387,540 B2
(45) Date of Patent: Jul. 12, 2022

(54) ANTENNA STEERING AND LOCKING APPARATUS

(71) Applicant: Dimitris Kolokotronis, Athens (GR)

(72) Inventor: Dimitris Kolokotronis, Athens (GR)

( * ) Notice: Subject to any disclaimer, the term of this patent is extended or adjusted under 35 U.S.C. 154(b) by 0 days.

(21) Appl. No.: 16/769,006

(22) PCT Filed: Dec. 5, 2018

(86) PCT No.: PCT/EP2018/083707

§ 371 (c)(1),
(2) Date: Jun. 2, 2020

(87) PCT Pub. No.: WO2019/110697

PCT Pub. Date: Jun. 13, 2019

(65) Prior Publication Data

US 2021/0226314 A1 Jul. 22, 2021

(30) Foreign Application Priority Data

Dec. 5, 2017 (GB) ..... 1720251

(51) Int. Cl.
*H01Q 1/12* (2006.01)
*H01Q 3/06* (2006.01)

(52) U.S. Cl.
CPC ..... *H01Q 1/125* (2013.01); *H01Q 1/1228* (2013.01); *H01Q 3/06* (2013.01)

(58) Field of Classification Search
CPC ..... H01Q 1/12; H01Q 1/1207; H01Q 1/1228; H01Q 1/1242; H01Q 1/125; H01Q 1/1264; H01Q 3/02; H01Q 3/04; H01Q 3/06
See application file for complete search history.

(56) References Cited

U.S. PATENT DOCUMENTS 2,415,103 A 2/1947 Langstroth
3,505,890 A 4/1970 Peterson
7,525,507 B1 4/2009 Henry, Jr.
(Continued)

FOREIGN PATENT DOCUMENTS

CA 2183942 A1 4/1999
CN 2807500 Y 8/2006
(Continued)

OTHER PUBLICATIONS

UK Intellectual Property Office, Patent Act 1977: Search Report under Section 17(5), GB Application Serial No. GB1720251.6, dated Jun. 6, 2018.
(Continued)

*Primary Examiner* — Seokjin Kim
(74) *Attorney, Agent, or Firm* — Reichel Stohry Dean LLP; Natalie J. Dean; Mark C. Reichel

(57) ABSTRACT

A cellular antenna steering and locking apparatus (100) has a first bracket (158) for attachment to a fixed structure, a second bracket (198) for attachment to a cellular antenna, a joint arrangement between the first and second brackets to facilitate rotation there between about a pivot axis and a locking mechanism (104) having a first condition in which rotation between the first and second brackets is prohibited, and a second condition in which rotation between the first and second brackets is permitted, the locking mechanism having a control (114) rotatable between the first and second conditions.

16 Claims, 31 Drawing Sheets

(56) References Cited

U.S. PATENT DOCUMENTS

| | | | | |
|---|---|---|---|---|
| 2010/0225802 | A1 | 9/2010 | Yamamoto | |
| 2016/0268669 | A1* | 9/2016 | Wilcox | H01Q 1/125 |
| 2019/0027825 | A1* | 1/2019 | Fang | F16H 1/28 |
| 2020/0303816 | A1* | 9/2020 | Huang | F16H 3/70 |

FOREIGN PATENT DOCUMENTS

| | | | |
|---|---|---|---|
| CN | 202616412 | U | 12/2012 |
| EP | 2532901 | A1 | 12/2012 |
| GB | 2505066 | A | 2/2014 |
| WO | 2017174113 | A1 | 10/2017 |

OTHER PUBLICATIONS

International Searching Authority, International Search Report, PCT Application Serial No. PCT/EP2018/083707, dated Mar. 27, 2019.
International Searching Authority, Written Opinion of the International Searching Authority, PCT Application Serial No. PCT/EP2018/083707, dated Mar. 27, 2019.

* cited by examiner

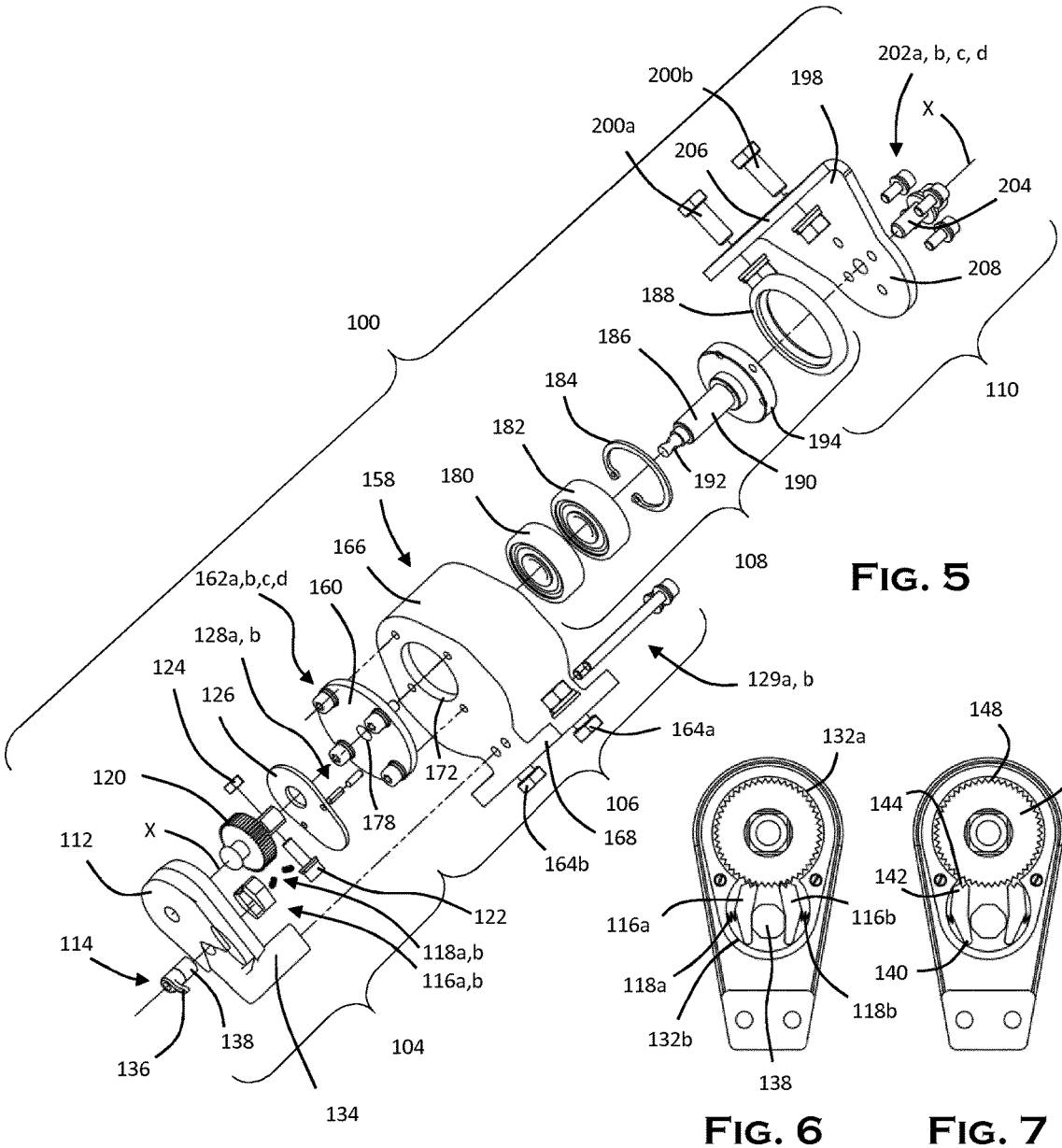
FIG. 5
FIG. 6
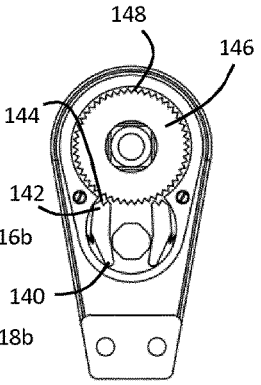
FIG. 7

ANTENNA STEERING AND LOCKING APPARATUS

PRIORITY

The present application is related to, and claims the priority benefit of, and is a 35 U.S.C. 371 national stage application of, International Patent Application Serial No. PCT/EP2018/083707, filed Dec. 5, 2018, which is related to, and claims the priority benefit of Great Britain Patent Application Serial No. 1720251.6, filed Dec. 5, 2017. The contents of each of the aforementioned applications are hereby incorporated by reference in their entireties into this disclosure.

TECHNICAL FIELD

The present invention is concerned with an antenna steering and locking apparatus. More specifically, the present invention is concerned with an antenna steering and locking apparatus for a cellular antenna which facilitates manual and automatic azimuth adjustment.

BACKGROUND

It is well known to mount cellular antennas in the art. The applicant's previous application published as WO 2013/171291 describe several configurations of antenna mount. Such antenna mounts preferably have the ability to steer the antenna about a vertical axis—i.e. to adjust the azimuth of the antenna.

The present application is particularly concerned with antennas for use with cellular communication. Such antennas are typically directional, and usually elongate in form, mounted vertically. The antennas are also heavy-weighing several tens of kilograms. The ability to steer the antenna and thereby adjust its azimuth is very important to provide optimal network coverage to the users. Further, it is important that azimuth steering is carried out accurately and that the antenna remains in the desired position when set.

Although many antennas are manually adjusted by technicians, remote-controlled, automated cellular antennas are becoming more common, and the present invention is relevant to both types as will be described below.

Weight and wind load are widely acknowledged factors to consider when designing and operating a cellular communications antenna. Weight is a constant and predictable load on an antenna mast, but wind loading is dynamic and often unpredictable. All weight and wind loads need to be reacted by the structure supporting the antenna-specifically a mast or tower.

Excessive weight and wind load can cause performance problems, specifically when antennas move under their own weight or the force of the wind. There is also a safety concern—overloaded or high wind-resistant configurations may present a danger to service personnel, as such configurations may move without warning.

Problems with weight and wind loading become more serious when more antennas are fitted to existing installations. Due to the demand on cellular networks, this is becoming increasingly common. As capacity needs to be increased, and new technologies evolve, the tendency is for more antennas to be installed on a single mast.

Current installation techniques exacerbate the weight and wind loading problems.

It is an aim of the present invention to provide an improved antenna steering and locking apparatus.

BRIEF SUMMARY

According to a first aspect of the invention there is provided a cellular antenna steering and locking apparatus comprising:

- a first bracket for attachment to a fixed structure;
- a second bracket for attachment to a cellular antenna;
- a joint arrangement between the first and second brackets to facilitate rotation therebetween about a pivot axis; and,
- a locking mechanism having a first condition in which rotation between the first and second brackets is prohibited, and a second condition in which rotation between the first and second brackets is permitted, the locking mechanism having a toothed ratchet and a ratchet-engaging member, the ratchet-engaging member being selectively engageable with the teeth of the ratchet to lock the joint arrangement against rotation in at least one rotational direction.

Advantageously, the use of a toothed ratchet provides a high degree of adjustability and precision. Preferably the ratchet has at least 20 teeth. The ratchet and ratchet-engaging member have a plurality of positions in which they are engaged together. Preferably those positions are N in number where 360/N=A where A is an integer angle between positions. For example, if the ratchet has N=20 positions, it will have 20 teeth each A=18 degrees apart. In another embodiment, the apparatus may have N=72 positions which are A=5 degrees apart. In another embodiment the apparatus may have N=180 positions which are A=2 degrees apart. The values of N or A can be chosen to suit the degree of accuracy required, although as mentioned it is preferred that N and A are integer values.

Preferably:

- the first ratchet-engaging member is configured to lock the joint arrangement at a first set of predetermined angular positions of the joint arrangement; and,
- the locking mechanism comprises a second ratchet-engaging member, in which the second ratchet-engaging member has a locked condition in which it is engaged with the teeth of the first ratchet to lock the joint arrangement against rotation in at least the first rotational direction, and in which the second ratchet-engaging member is configured to lock the joint arrangement at a second set of predetermined angular positions interleaving the first set of predetermined angular positions.

This allows the system to have a finer resolution than would otherwise be permitted by the number of teeth on the ratchet. For example with teeth 10 degrees apart, a 5 degree offset (or "phase offset") of the second ratchet-engaging member compared to the first would allow a 5 degree resolution.

This may be facilitated by having the second ratchet-engaging member offset relative to the first. Specifically, the second ratchet-engaging member can be positioned at a rotational position of A1/2 degrees about the pivot axis compared to the first ratchet-engaging member, where A1 is the angular tooth spacing of the ratchet.

Alternatively, the second ratchet-engaging member can be shaped differently to the first so as to provide locking at the second set of predetermined angular positions. This allows the first and second ratchet-engaging members to be pivotable about a common axis, offset from the pivot axis.

Preferably the locking mechanism comprises a first opposed ratchet-engaging member, the first opposed ratchet-engaging member having a locked condition in which it is engaged with either the teeth of the first ratchet or teeth of a second ratchet to lock the joint arrangement against rotation in at least a second rotational direction, opposite to the first rotational direction.

Preferably the first ratchet-engaging member and the first ratchet are configured to permit rotational movement in the second direction in the locked condition.

Preferably the first opposed ratchet-engaging member and the first or second ratchet are configured to permit rotational movement in the locked direction.

This allows e.g. the first ratchet-engaging member to be rotated in the first direction, keeping the opposed ratchet-engaging member engaged. This is advantageous as it limits e.g. back-driving by gusts of wind, which may damage the antenna or the actuation mechanism and/or motor which drives the antenna.

The first ratchet may comprise a first set of teeth for engagement with the first ratchet-engaging member, and a second set of teeth for engagement with the first opposed ratchet-engaging member. The first and second sets of teeth may span a portion of the circumference of the ratchet, and may be symmetrical.

The first and second sets of teeth may be raked in opposite rotational directions.

Preferably the ratchet engaging member is manually moveable between the first and second conditions.

Preferably the ratchet engaging member is moveable between the first and second conditions by an actuator.

Preferably the ratchet engaging member is configured to engage a plurality of the teeth of the ratchet in the first condition.

Preferably the ratchet engaging member is resiliently biased into the first condition.

Preferably the ratchet engaging member is a pawl, the pawl being pivotable between the first and second conditions.

Preferably the pawl is biased into the first condition by a spring.

Preferably there is provided a further pawl being pivotable between the first and second conditions.

Preferably the pawl and the further pawl move towards each other when moving from the second to the first condition.

Preferably an actuation member is positioned between the pawls and configured to selectively urge the pawls apart to move from the first to the second condition.

Preferably the actuation member comprises a cam.

Preferably the ratchet engaging member is linearly moveable between the first and second conditions.

Preferably the ratchet engaging member is moveable in a radial direction relative to the ratchet.

Preferably the ratchet engaging member comprises at least one elastically deformable member being elastically deformable between the first and second condition.

Preferably the ratchet engaging member comprises a plurality of elastically deformable members Preferably the deformable members surround the ratchet.

Preferably there is a collar surrounding the deformable members, in which axial movement of the collar deforms the members into the first condition.

Preferably at least one of the deformable members and the collar comprises a tapered surface to effect the deformation.

Preferably there is an elongate central mounting structure having a main axis being vertical in use, and a first pair of cellular antenna steering and locking apparatuses according to any preceding claim being spaced along the axis and located so as to receive a first antenna thereon.

Preferably there is at least one further pair of cellular antenna steering and locking apparatuses according to the first aspect, being spaced along the axis and located so as to receive a second antenna thereon.

The invention also provides a method of steering and locking a cellular antenna comprising the steps of:

- providing a steering and locking apparatus according to any preceding claim;
- providing an antenna attached to the steering and locking apparatus;
- moving the steering and locking apparatus to the second condition;
- rotating the antenna; and,
- moving the steering and locking apparatus into the first condition to thereby lock the position of the antenna.

The invention also provides a cellular antenna locking mechanism having a first toothed ratchet and a first ratchet-engaging member, the first ratchet-engaging member having a locked condition in which it is engaged with the teeth of the first ratchet to lock a rotational joint arrangement against rotation in at least a first rotational direction. The locking mechanism may have any of the aforementioned features or combinations of features described herein.

According to a further aspect of the invention, there is provided a cellular antenna mounting system comprising:

- a mast comprising a load-bearing mast member, the load bearing mast member forming an integral part of the mast;
- a clamp comprising a first clamp member and a second clamp member;
- a steering unit comprising a rotational joint; and,
- a cellular antenna;

wherein:

- the load-bearing mast member is clamped between the first clamp member and the second clamp member to hold the clamp in position relative to the mast;
- the steering unit is mounted to the first clamp member; and,
- the antenna is attached to the steering unit such that the antenna is moveable about the rotational joint relative to the mast.

Preferably the system is used with a steering and locking unit according to the first aspect.

BRIEF DESCRIPTION OF THE DRAWINGS

An example antenna mounting, steering and locking apparatus will now be described with reference to the accompanying drawings in which:

FIG. 5 is an exploded view of the antenna steering and locking apparatus of FIG. 2;

FIG. 6 is a section view of the antenna steering and locking apparatus of FIG. 2, along line A-A in FIG. 4, in a first mode of operation;

FIG. 7 is a section view of the antenna steering and locking apparatus of FIG. 2, along line A-A in FIG. 4, in a second mode of operation;

DETAILED DESCRIPTION

The First Embodiment

Structure

In the following description, words such as "vertical" and "horizontal" are used to refer to the subject feature in-use. "Longitudinal" generally refers to a direction parallel to the long axis of an elongate object, and "transverse" to directions normal to the longitudinal direction.

Figure 1:
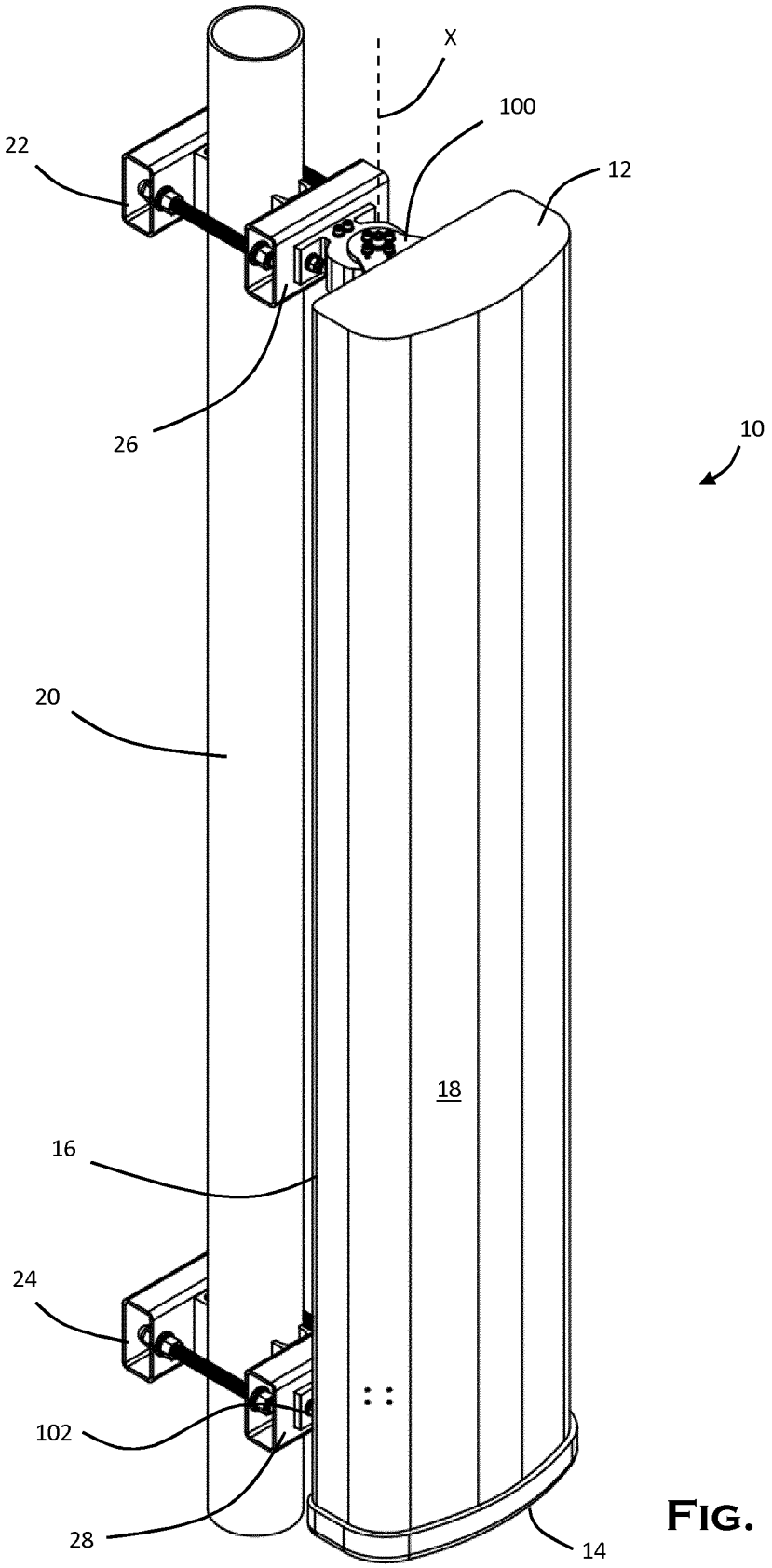
FIG. 1 is a perspective view of an antenna mounted to a pole using two first antenna steering and locking apparatuses according to the present invention.
Figure 2:
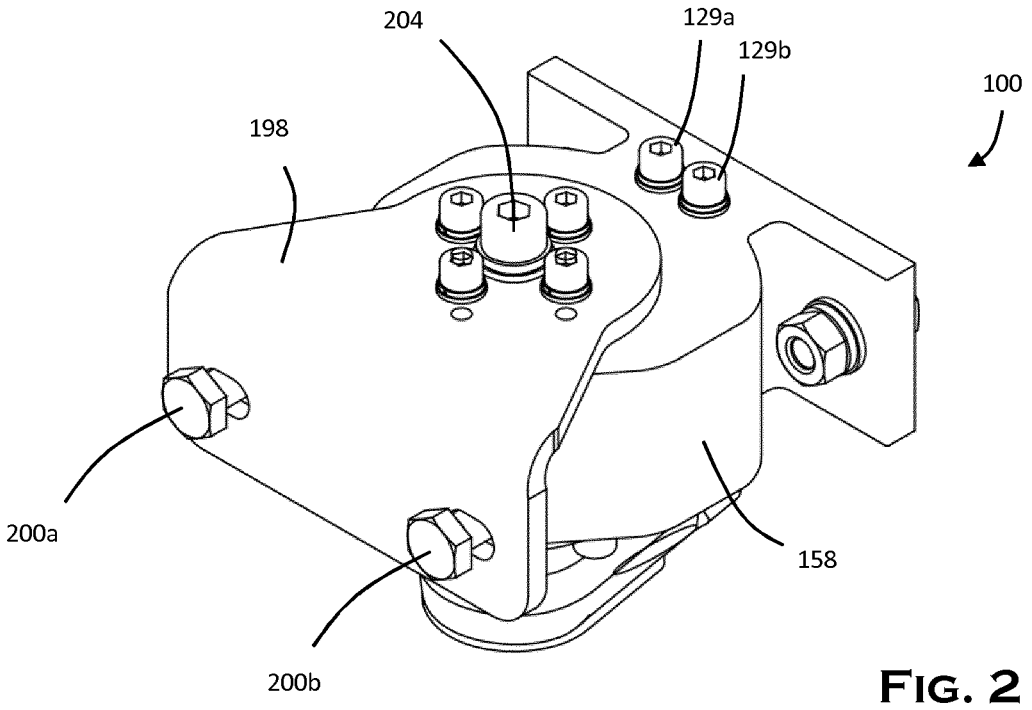
FIG. 2 is a first perspective view of an antenna steering and locking apparatus of FIG. 1.
Figure 3:
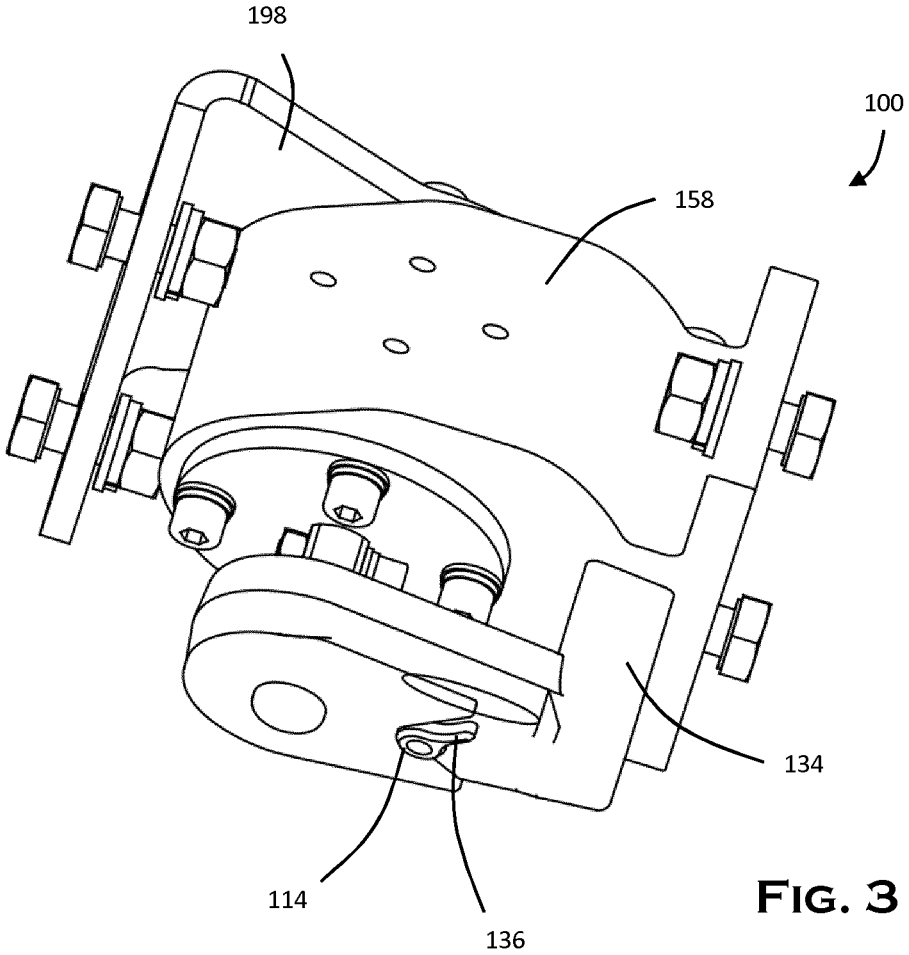
FIG. 3 is a second perspective view of the antenna steering and locking apparatus of FIG. 2.

Referring to FIG. 1, there is provided a cellular antenna 10 being elongate in form having a first end 12, a second end 14, a flat back face 16 and a curved front face 18. Constructional details of the antenna 10 will not be discussed further here, suffice to say that the antenna is a direction antenna configured to send and receive signals as part of a mobile phone network.

FIG. 1 also shows a vertical pole 20, which is statically mounted to e.g. a building. The pole 20 is merely an example, and may be any other appropriate structure for mounting an antenna to (e.g. a mast). The exact position of the pole 20 is known by the operator.

A first pole clamp 22 and a second pole clamp 24 are also provided, being spaced apart in the longitudinal direction of the pole 20. Each pole clap 22, 24 is immovably (but adjustably and removably) attached to the pole 20. Each clamp presents a respective mounting face 26, 28 which is generally vertical and extending in a transverse direction relative to the pole 20.

A first antenna steering and locking apparatus 100, and a second antenna steering and locking apparatus 102 are provided between the respective clamps 22, 24 and the antenna 10. The steering and locking apparatuses 100, 102 are identical to each other, and as such only the apparatus 100 will be described in detail here.

Referring to FIGS. 2 to 7, the apparatus 100 is shown in detail. Referring specifically to FIG. 5, the apparatus 100 comprises:

A locking mechanism subassembly 104;

A first mounting subassembly 106;

A bearing subassembly 108; and,

A second mounting subassembly 110.

Locking Mechanism Subassembly 104

The locking mechanism subassembly 104 comprises a locking mechanism housing 112, a control 114, two pawls 116*a, b*, two pawl springs 118*a, b*, a ratchet 120, a shaft bolt 122, a shaft nut 124, a locking mechanism housing cover 126, two locking mechanism housing screws 128*a, b* and two locking mechanism attachment screws 129*a, b*.

Figure 4:
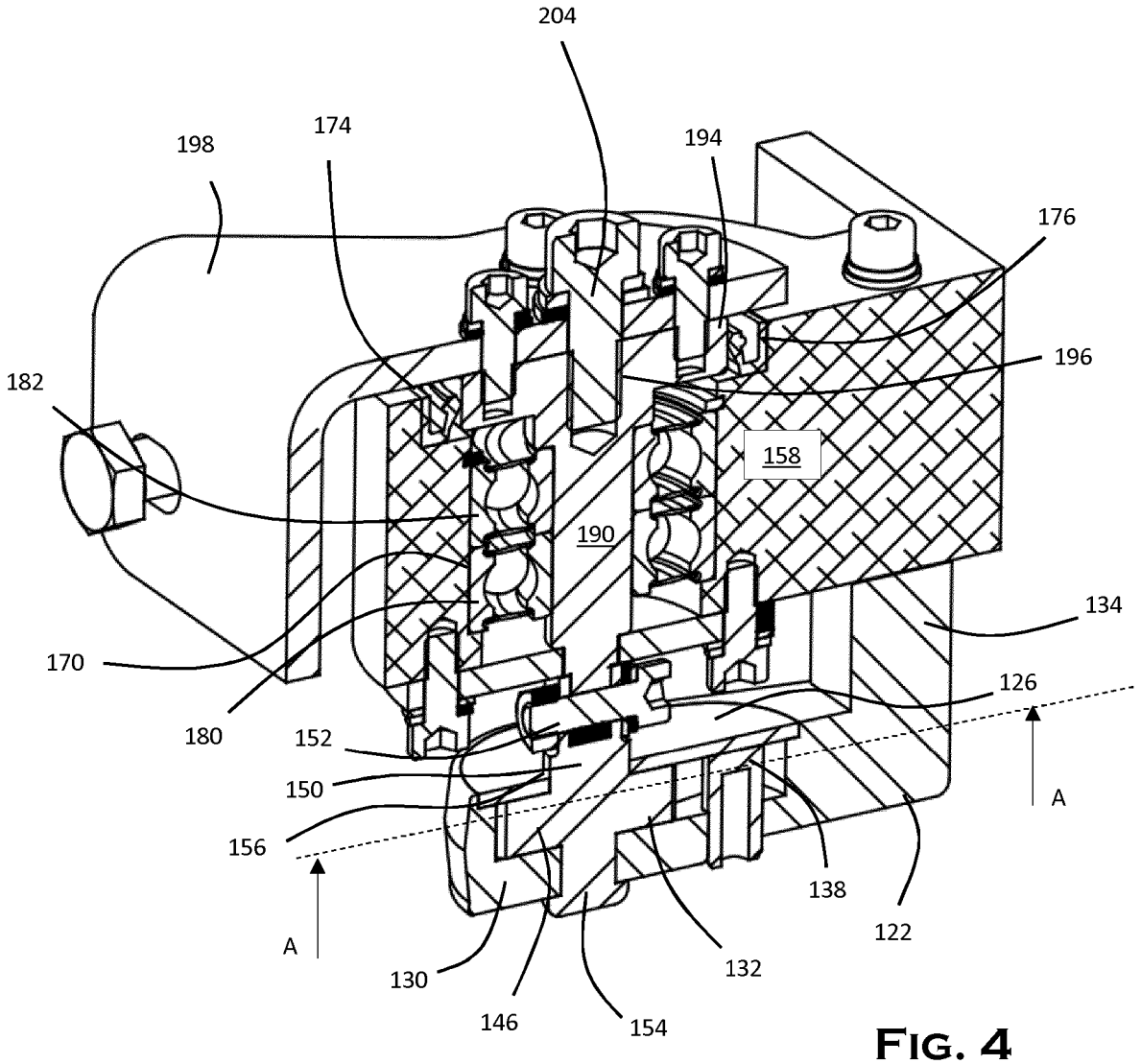
FIG. 4 is a section view of the antenna steering and locking apparatus of FIG. 2.

The locking mechanism housing 112 comprises a generally planar portion 130 (FIG. 4) defining a locking mechanism recess 132 on one face thereof. The locking mechanism recess 132 has a first portion 132*a* and a second portion 132*b*, each of which are circular, forming a "figure of eight" shape in plan (FIG. 6). A housing attachment leg 134 projects normal to the planar portion. As shown in FIG. 4, the locking mechanism housing 112 is generally "L" shaped in section.

The control 114 is generally cylindrical having an arm 136 projecting therefrom at a first end, and a cam in the shape of a prismatic, polygonal section 138 at a second end. The polygonal section 138 is in the shape of a regular octagon in section (FIG. 6).

The pawls 116*a, b* are generally crescent-shaped in section (FIGS. 6 and 7). The pawls 116*a, b* are identical (although mirror-images of each other). As such only the pawl 116*a* will be described with reference to FIG. 7. The pawl 116*a* comprises a first end 140 which is has a rounded, smooth surface and a second end 142 defining a ratchet-engaging formation 144 in the form of two teeth defining a groove therebetween.

The pawl springs 118*a*, 118*b* are simple compression springs.

The ratchet 120 has a cylindrical portion 146 defining a set of ratchet teeth 148 on a radially outwardly facing surface thereof (FIG. 7). A first locking mechanism shaft 150 projects from a first side of the cylindrical portion 146. The first locking mechanism shaft 150 is hollow, having an open end and defining a radial bore 152 through the walls thereof (FIG. 4). A second locking mechanism shaft 154 extends opposite the first locking mechanism shaft 150.

The locking mechanism housing cover 126 is shaped to fit into, and seal, the locking mechanism recess 132 as shown in FIG. 4. It defines a shaft opening 156 therethrough.

First Mounting Subassembly 106

The first mounting subassembly 106 comprises a bracket 158, a bearing cover plate 160, four bearing cover plate screws 162*a, b, c, d* and two first mounting subassembly attachment bolts 164*a, b*.

The bracket 158 is a generally prismatic block of material having a bearing housing portion 166 and an attachment flange 168. The bearing housing portion 166 defines an internal cylindrical bearing cavity 170 (FIG. 4) having a first opening 172 in a first side of the housing portion 166 and a second opening 174 in a second side of the housing portion 166. The second opening 174 is stepped defining a shoulder 176.

The bearing cover plate 160 is flat, planar and circular defining a central shaft aperture 178.

Bearing Subassembly 108

The bearing subassembly 108 comprises a first roller bearing 180, a second roller bearing 182, a circlip 184, a pivot pin 186 and a seal 188.

The first and second roller bearings 180, 182 are off-the-shelf components and as known in the art comprise an inner race, an outer race and a plurality of rolling elements disposed in an annular arrangement therebetween to facilitate relative rotational movement of the races. As such, the bearings 180, 182 require no further description.

The pivot pin 186 comprises a shaft 190 having a radial bore 192 at a first end, and a cylindrical flange 194 at a second end. A threaded bore 196 is defined at the flange end (FIG. 4).

Second Mounting Subassembly 110

The second mounting subassembly 110 comprises a bracket 198, two bracket mounting bolts 200*a, b*, four bracket attachment bolts 202*a, b, c, d* and a pivot bolt 204.

The bracket 198 is constructed from plate metal, and is L-shaped when viewed from the side. The bracket 198 comprises a mounting flange 206 and an attachment flange 208 which are normal to each other.

Assembly

The first antenna steering and locking apparatus 100 is assembled as follows, with reference to FIGS. 4 and 5.

The locking mechanism ratchet 120 is mounted for rotation within the locking mechanism housing 112. The second locking mechanism shaft 154 engages a corresponding bore through the locking mechanism housing to form a plain bearing about a pivot axis X. The cylindrical portion 146 of the ratchet sits within the first portion 132*a* of the locking mechanism recess 132 (FIG. 6).

The control 114 is also mounted for rotation about a control axis Y within the locking mechanism housing 112, and projects from an exterior side of the housing (where the arm 136 is located) into the second portion 132*b* of the locking mechanism recess 132 (where the polygonal section 138 is located). The pawls 116*a, b* are located on either side of the control 114 within the second portion 132*b* of the locking mechanism recess 132. The concave sides of the pawls 116*a, b* abut the exterior surface of the polygonal section 138 of the control 114. The first ends 140 of the pawls rest against the interior surface of the second portion 132*b* of the recess 132, and the second ends 142 face the exterior surface of the ratchet 120. The pawl springs 118*a*, 118*b* are positioned between the convex sides of the pawls and the inside of the second portion 132*b* of the locking mechanism recess 132 such that the pawl springs 118*a*, 118*b* urge the pawls 116*a*, 116*b* towards the control 114, and more importantly into engagement with the ratchet 120 as will be discussed below.

The locking mechanism housing cover 126 seals the locking mechanism recess 132 with the first locking mechanism shaft 150 projecting therethrough (FIG. 4).

The bearings 180, 182 are press-fitted into the bearing cavity 170 of the bracket 158 and secured with the circlip 184 which engages an internal groove in the bracket 158. The pivot pin 186 is passed through the bracket 158 and bearings 180, 182 such that it forms a press-fit with the inner races of the bearings 180, 182. In this way, the pivot pin 186 is configured to rotate relative to the bracket 158 about the pivot axis X. The seal 188 sits between the exterior surface of the flange 194 of the pivot pin 186 and the interior surface of the shoulder 176 (FIG. 4). The first end of the shaft 190 of the pivot pin 186 with the radial bore 192 projects from the bracket 158.

The locking mechanism subassembly 104 is mounted to the first mounting subassembly 106 and bearing subassembly 108 by engaging the shaft 190 of the pivot pin 186 into the opening in the first locking mechanism shaft 150. The shaft bolt 122 and corresponding nut 124 are used to secure the shaft 190 of the pivot pin 186 and the first locking mechanism shaft 150 together.

The locking mechanism housing 112 is attached to the bracket 158 by securing the housing attachment leg 134 to the bracket 158 with the locking mechanism attachment screws 129*a*, 129*b*. It is noted that the attachment point is distal to the pivot axis X, as the attachment will need to react the rotational forces about that axis.

The bracket 198 of the second mounting subassembly 110 is attached to the pivot pin 186 using the four bracket attachment bolts 202*a, b, c, d* and the pivot bolt 204.

When assembled, the apparatus 100 can be mounted to an antenna and pole as shown in FIG. 1. The bracket 158 of the first mounting subassembly 106 is mounted to the pole clamp 26 using the two first mounting subassembly attachment bolts 164*a, b*. The bracket 198 of the second mounting subassembly 110 is mounted to the flat face 16 of the antenna 10 using the two bracket mounting bolts 200*a, b*.

In use, the pivot axis X is typically aligned with the vertical axis (i.e. azimuth axis). In some installations, it may be tilted, but is generally within 30 degrees of vertical.

Function

The apparatus 10 has two primary modes of operation—fixed and rotatable.

In the fixed mode, the control 114 is rotated into a first position such that the polygonal section 138 allows the pawls 116*a*, 116*b* to move towards it under the force of the pawl springs 118*a, b*. This is shown in FIG. 6. This rotation means that the ratchet-engaging formations 144 of the teeth engage the ratchet teeth 148 of the ratchet 120 preventing any rotation about the axis X relative to the locking mechanism housing 112. Because the locking mechanism housing 112 is attached to the bracket 158, and the ratchet 120 is secured to the pivot pin which in turn is attached to the bracket 198, rotation of the antenna about the pivot axis X is prohibited.

To rotate the antenna 10, the control 114 is rotated through 45 degrees such that the pawls 116*a*, 116*b* are pushed outwardly against the bias of the springs 118*a*, 118*b* (FIG. 7). This disengages the ratchet-engaging formations 144 of the teeth from the ratchet teeth 148 of the ratchet 120 and allows rotation of the ratchet 120. This, in turn, permits azimuth rotation of the antenna about the pivot axis X.

The Second Embodiment

Referring to FIGS. 8 to 15, the second embodiment of the invention is similar to the first, and common reference numerals will be used to denote similar features. Only the differences between the embodiments will be described here.

Structure

Figure 8:
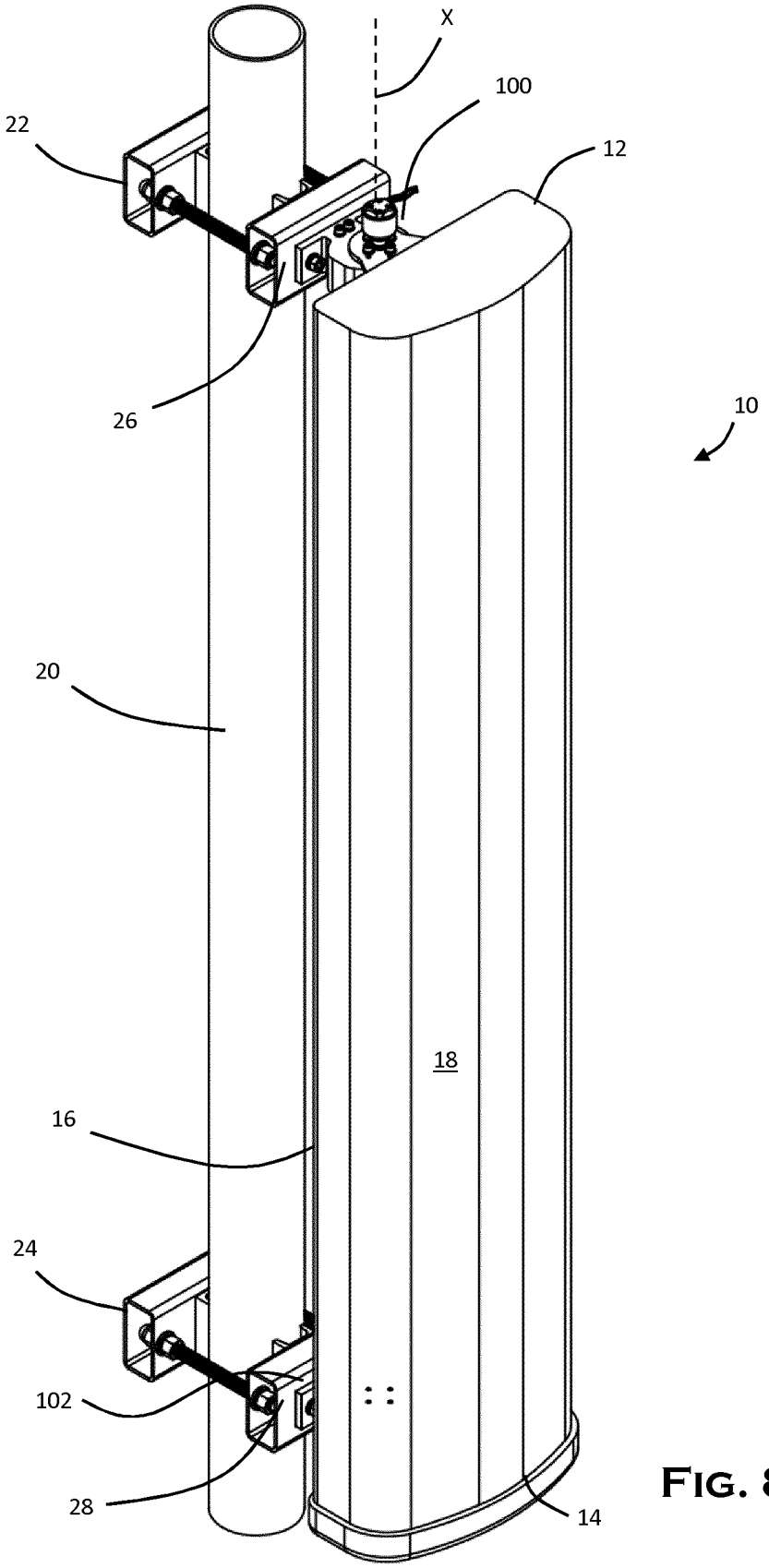
FIG. 8 is a perspective view of an antenna mounted to a pole using two second antenna steering and locking apparatuses according to the present invention.
Figure 9:
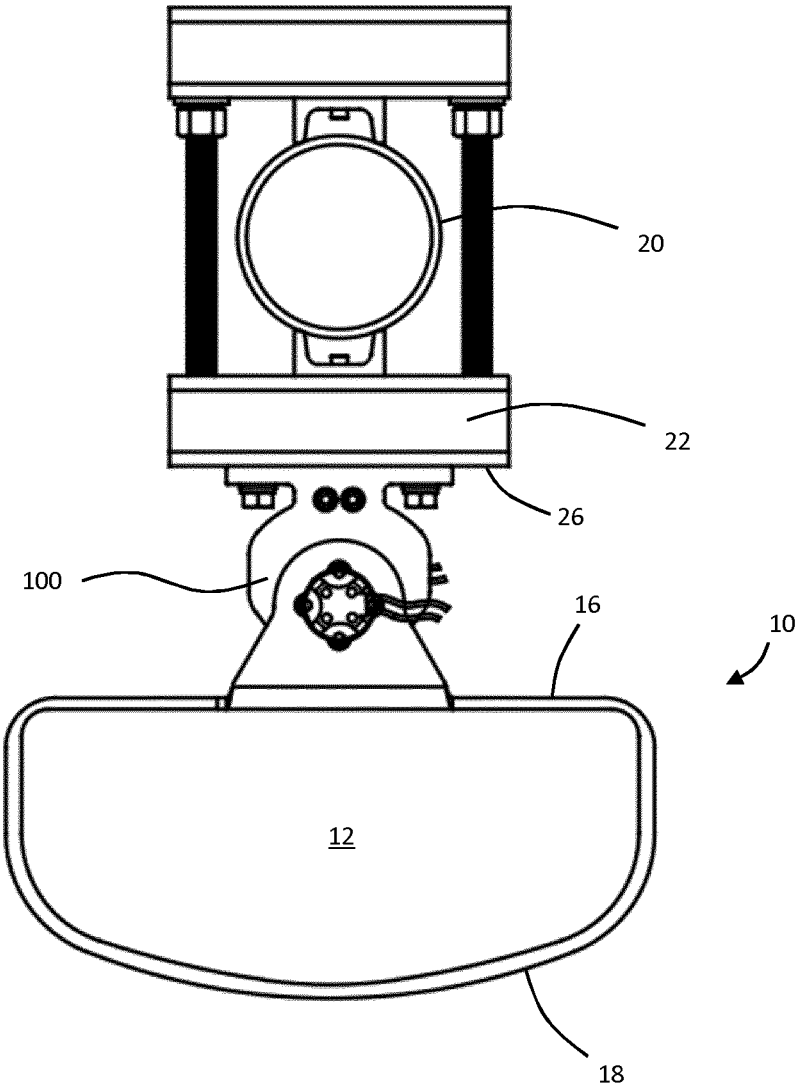
FIG. 9 is a plan view of the antenna of FIG. 8.

Referring to FIGS. 8 and 9, there is provided a cellular antenna 10 being elongate in form having a first end 12, a second end 14, a flat back face 16 and a curved front face 18. Constructional details of the antenna 10 will not be discussed further here, suffice to say that the antenna is a direction antenna configured to send and receive signals as part of a mobile phone network.

FIGS. 8 and 9 also show a vertical pole 20, which is statically mounted to e.g. a building. The pole 20 is merely an example, and may be any other appropriate structure for mounting an antenna to (e.g. a mast). The exact position of the pole 20 is known by the operator.

A first pole clamp 22 and a second pole clamp 24 are also provided, being spaced apart in the longitudinal direction of the pole 20. Each pole clap 22, 24 is immovably (but adjustably and removably) attached to the pole 20. Each clamp presents a respective mounting face 26, 28 which is generally vertical and extending in a transverse direction relative to the pole 20.

A first antenna steering and locking apparatus 100, and a second antenna steering and locking apparatus 102 are provided between the respective clamps 22, 24 and the antenna 10. The mounting apparatuses 100, 102 are identical to each other, and as such only the apparatus 100 will be described in detail here.

Figures 13, 14, 15:
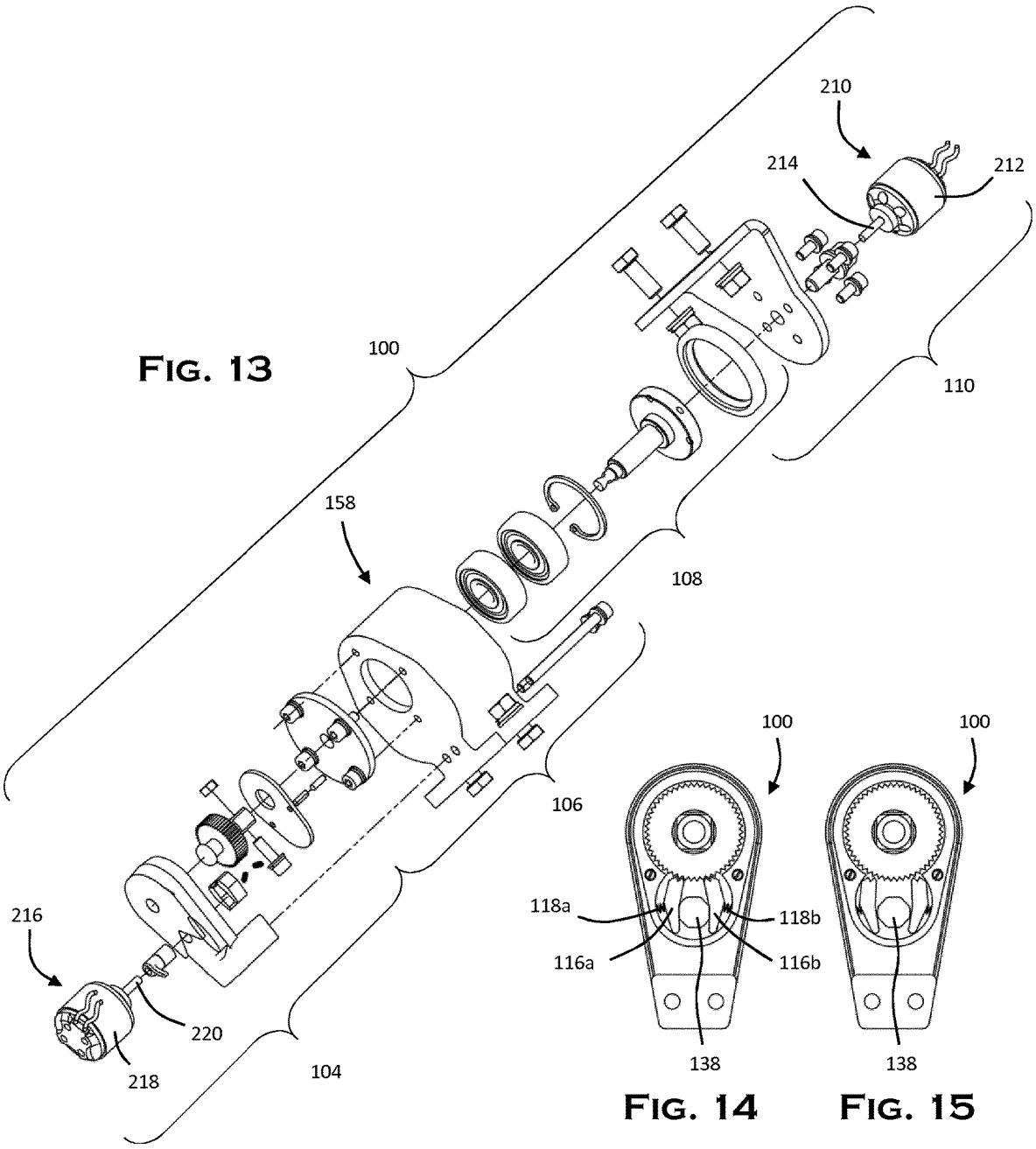
FIG. 13 is an exploded view of the antenna steering and locking apparatus of FIG. 10.
FIG. 14 is a section view of the antenna steering and locking apparatus of FIG. 10, along line A-A in FIG. 12, in a first mode of operation.
FIG. 15 is a section view of the antenna steering and locking apparatus of FIG. 10, along line A-A in FIG. 12, in a second mode of operation.

Referring to FIGS. 2 to 7, the apparatus 100 is shown in detail. Referring specifically to FIG. 13, the apparatus 100 comprises:

A locking mechanism subassembly 104;
A first mounting subassembly 106;
A bearing subassembly 108;
A second mounting subassembly 110; and,
A controller 222.

Locking Mechanism Subassembly 104

Unlike the locking mechanism subassembly of the first embodiment, the locking mechanism subassembly of the second embodiment comprises a actuator in the form of an electric motor 216. The motor 216 has a housing 218 and an output shaft 220. Note that in FIG. 12, the motor is shown schematically (and in reality would have several internal parts).

The housing 212 is attached to the locking mechanism housing 112 (not described in detail, but within the ability of the skilled man to envisage). The shaft 220 is engaged with control 114. As such, activation of the motor will rotate the control 114 to engage and disengage the locking mechanism as described above with reference to the first embodiment.

Second Mounting Subassembly 110

Unlike the second mounting subassembly of the first embodiment, the second mounting subassembly of the second embodiment comprises a actuator in the form of an electric motor 210. The motor 210 has a housing 212 and an output shaft 214. Note that in FIG. 12, the motor is shown schematically (and in reality would have several internal parts).

The housing 212 is attached to the housing 158 (not described in detail, but within the ability of the skilled man to envisage). The shaft 214 is engaged with the pivot pin 186. As such, activation of the motor will rotate the pivot pin 186 (and therefore the bracket 198 and antenna 10) relative to the housing 158, and pole 20.

Controller 222

Figure 10:
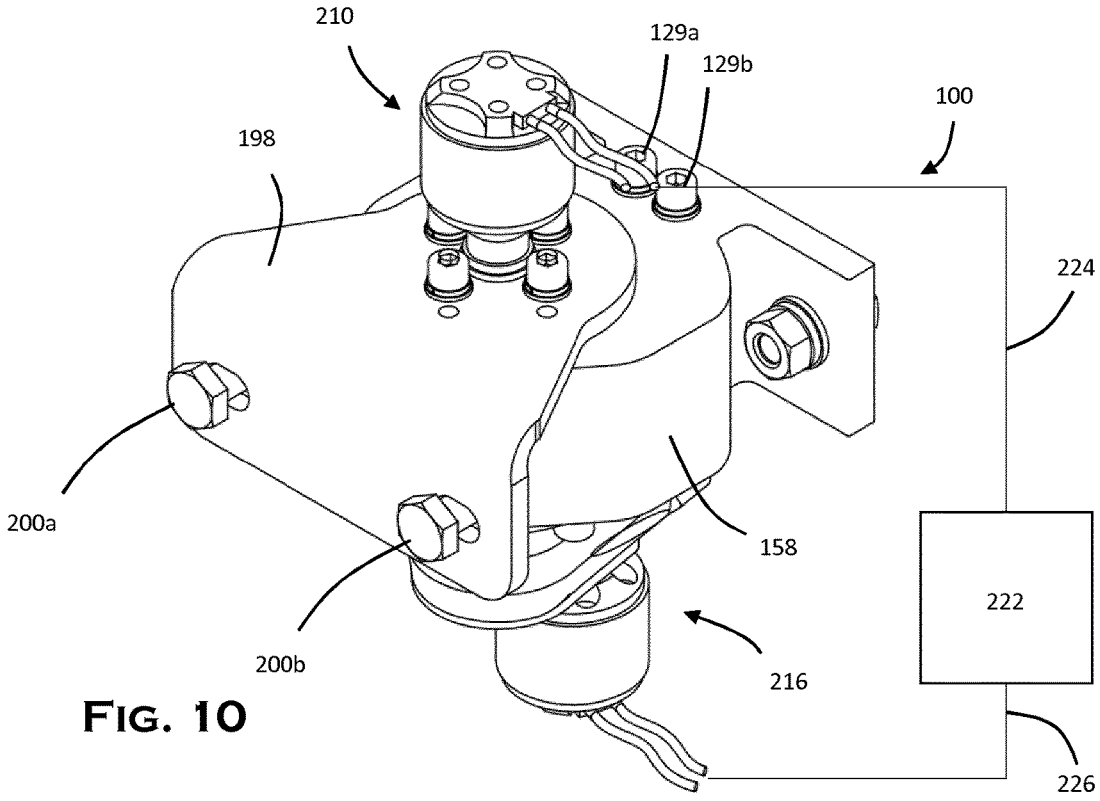
FIG. 10 is a first perspective view of an antenna steering and locking apparatus of FIG. 8.
Figure 11:
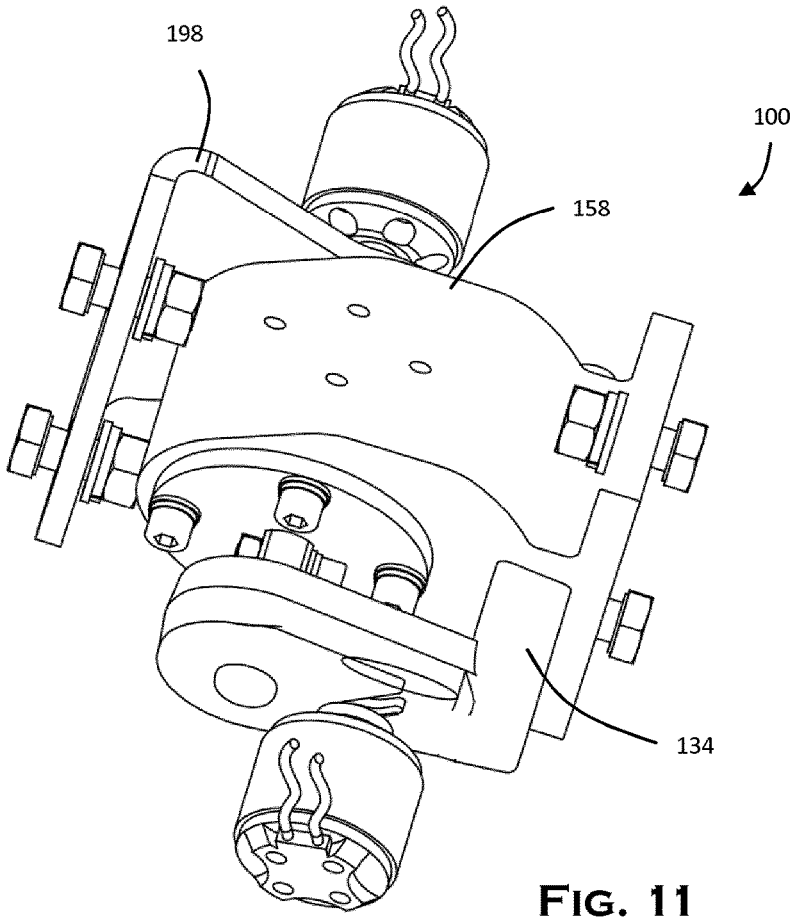
FIG. 11 is a second perspective view of the antenna steering and locking apparatus of FIG. 10.
Figure 12:
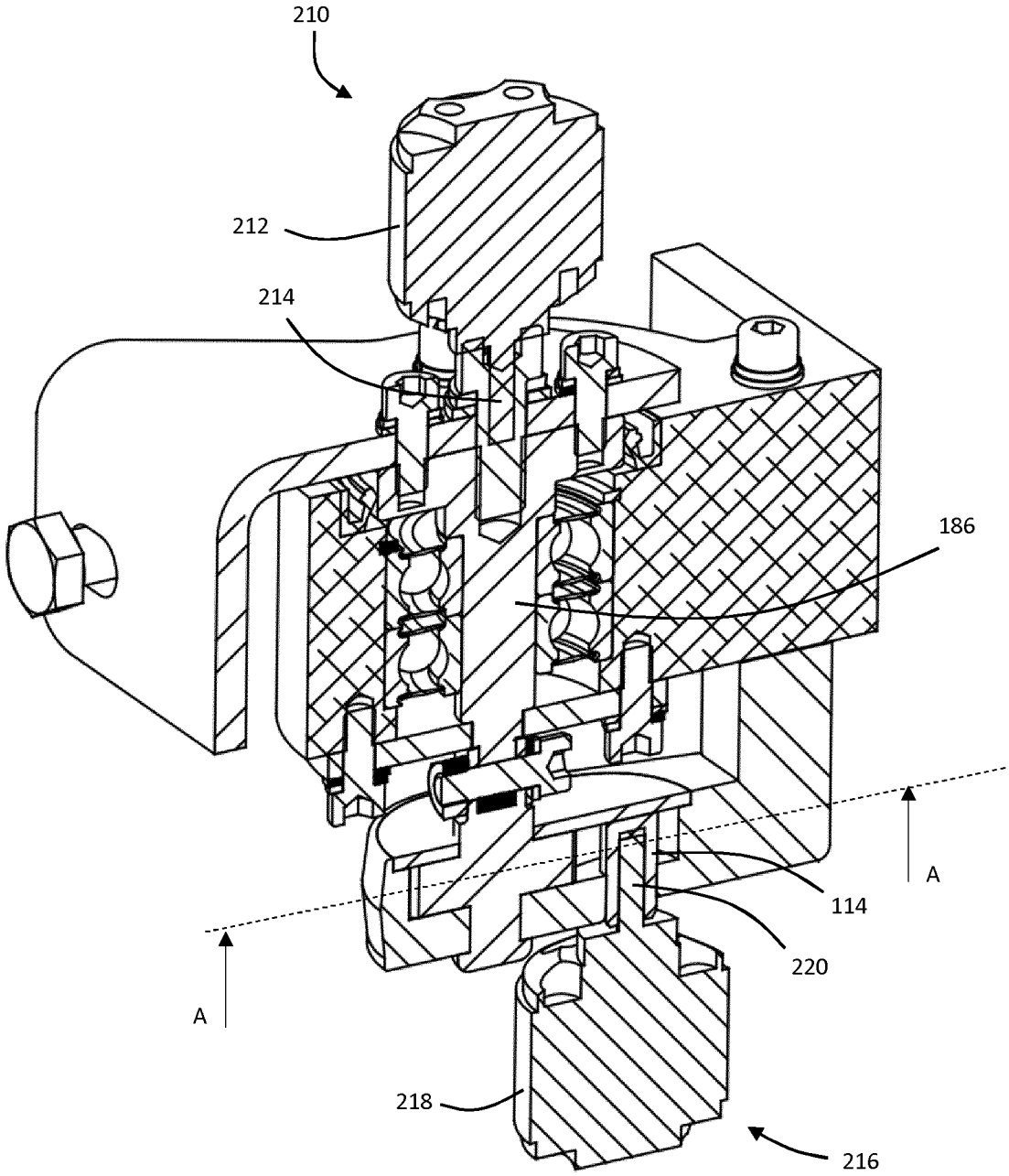
FIG. 12 is a section view of the antenna steering and locking apparatus of FIG. 10.

The controller 222 is connected to each motor 210, 216 via data connections 224, 226 respectively (FIG. 10). It will be noted that the controller 222 is connected in the same way to the motors of the second apparatus 102, and can control both sets of motors simultaneously.

Function

The controller 222 is configured to carry out the following sequence of operation:

Receive a command comprising azimuth adjustment data (for example, angle);
Engage the locking mechanism motor 216 to move the locking mechanism to the rotatable condition;
Engage the drive motor 210 to adjust the azimuth of the antenna to the desired position;
Engage the locking mechanism motor 216 to move the locking mechanism back to the fixed condition.

The Third Embodiment

Structure

Figure 16:
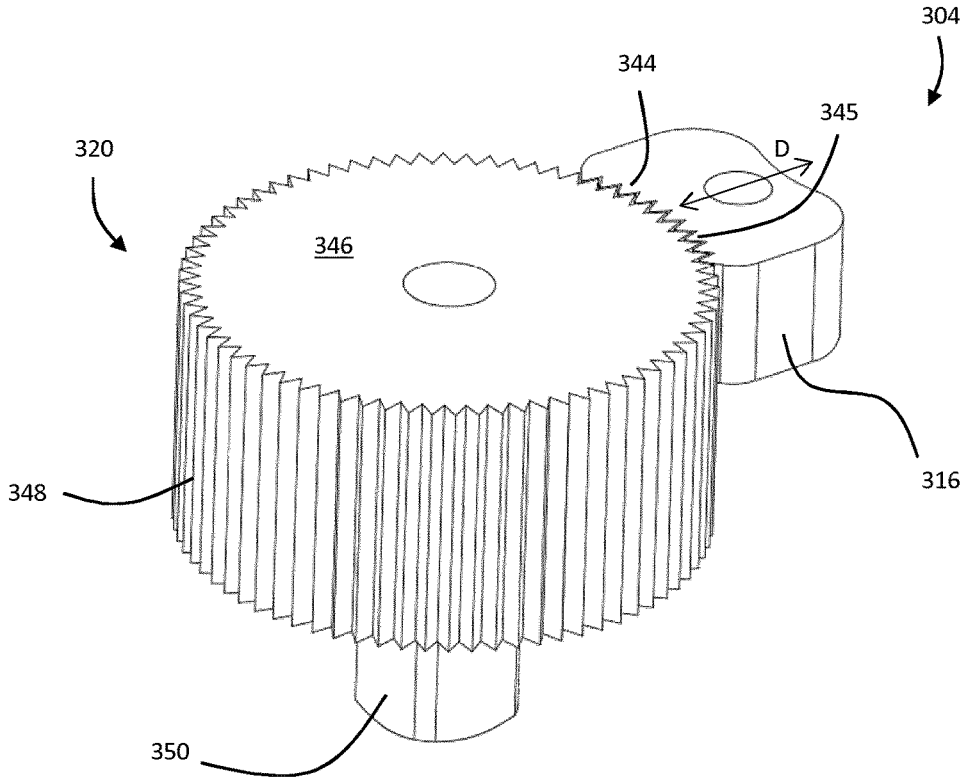
FIG. 16 is a perspective view of a subassembly of a third antenna steering and locking apparatus according to the invention.
Figure 18:
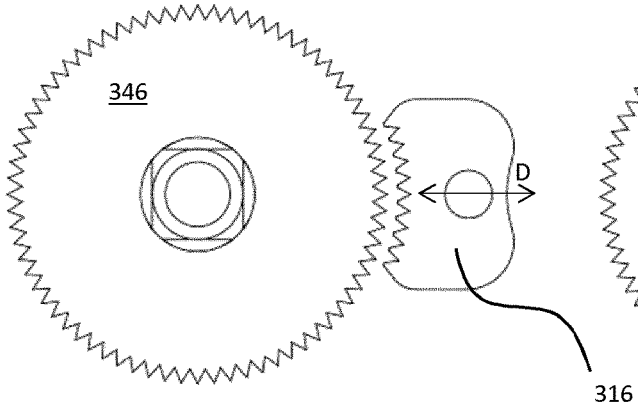
FIG. 18 is a plan view of the subassembly of FIG. 16 in a second mode of operation.
Figure 17:
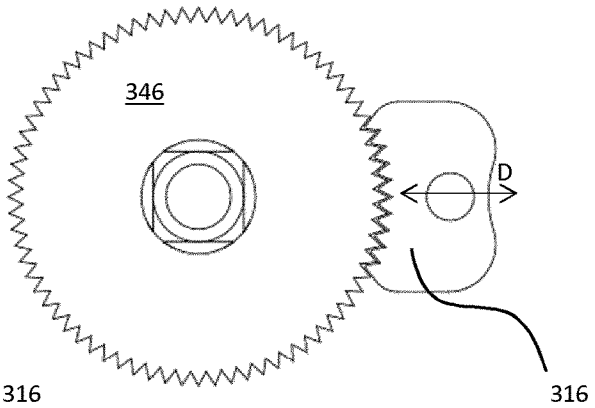
FIG. 17 is a plan view of the subassembly of FIG. 16 in a first mode of operation.

Referring to FIGS. 16 to 18, instead of using the two pawls 116*a, b*, and a ratchet 120 as shown in the first embodiment, a single ratchet-engaging member 316 and a ratchet 320 are provided as part of a locking mechanism subassembly 304.

The ratchet-engaging member 316 is a body defining a ratchet-engaging formation 344 at a first end thereof. The ratchet-engaging formation 344 is concave with the same radius of curvature as the ratchet 320 (discussed below) and defines a plurality of teeth 345. The ratchet-engaging member 316 is mounted for sliding movement within a housing of the locking mechanism subassembly 304 (not shown) in a direction D towards and away from the ratchet 320.

The ratchet 320 has a cylindrical portion 346 defining a set of ratchet teeth 348 on a radially outwardly facing surface thereof. A first locking mechanism shaft 350 projects from a first side of the cylindrical portion 346.

Function

Instead of using springs to pivot pawls into engagement with a ratchet, the ratchet-engaging member 316 can be moved between a first condition per FIG. 17 and a second condition per FIG. 18. In the first condition, the teeth 345 of the ratchet-engaging member 316 engage the teeth 348 of the ratchet 320 and thereby rotationally fix the ratchet 320. Per the ratchet 120, the ratchet 320 is rotationally fixed to the antenna mount, and as such the first condition is the fixed condition. In the second condition, the ratchet-engaging member 316 is moved in direction D away from the ratchet 320 such that the ratchet 320 and associated antenna can rotate. This is the rotatable condition.

In a further embodiment, the ratchet-engaging member 316 is biased to the first (fixed) condition by e.g. a spring or other resilient mechanism and can be either manually (per the first embodiment) or automatically (per the second embodiment) moved to the second (rotatable) condition.

The Fourth Embodiment

Structure

Figure 19:
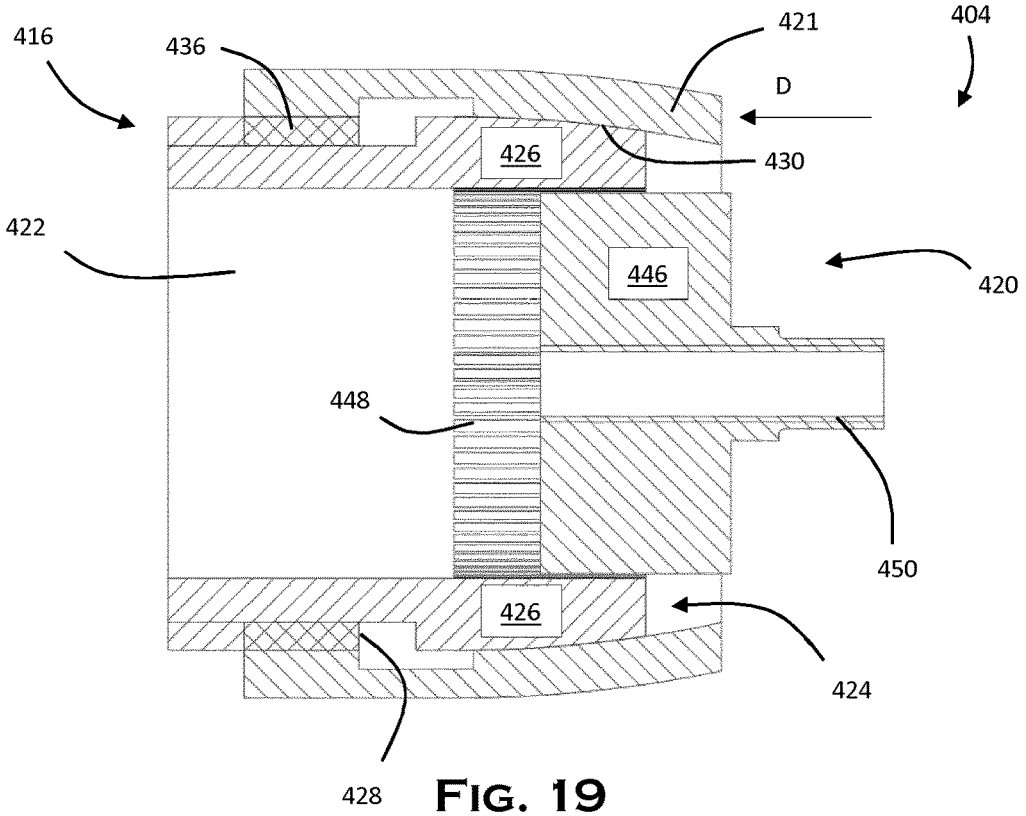
FIG. 19 is a section view of a subassembly of a fourth antenna steering and locking apparatus according to the invention.
Figure 20:
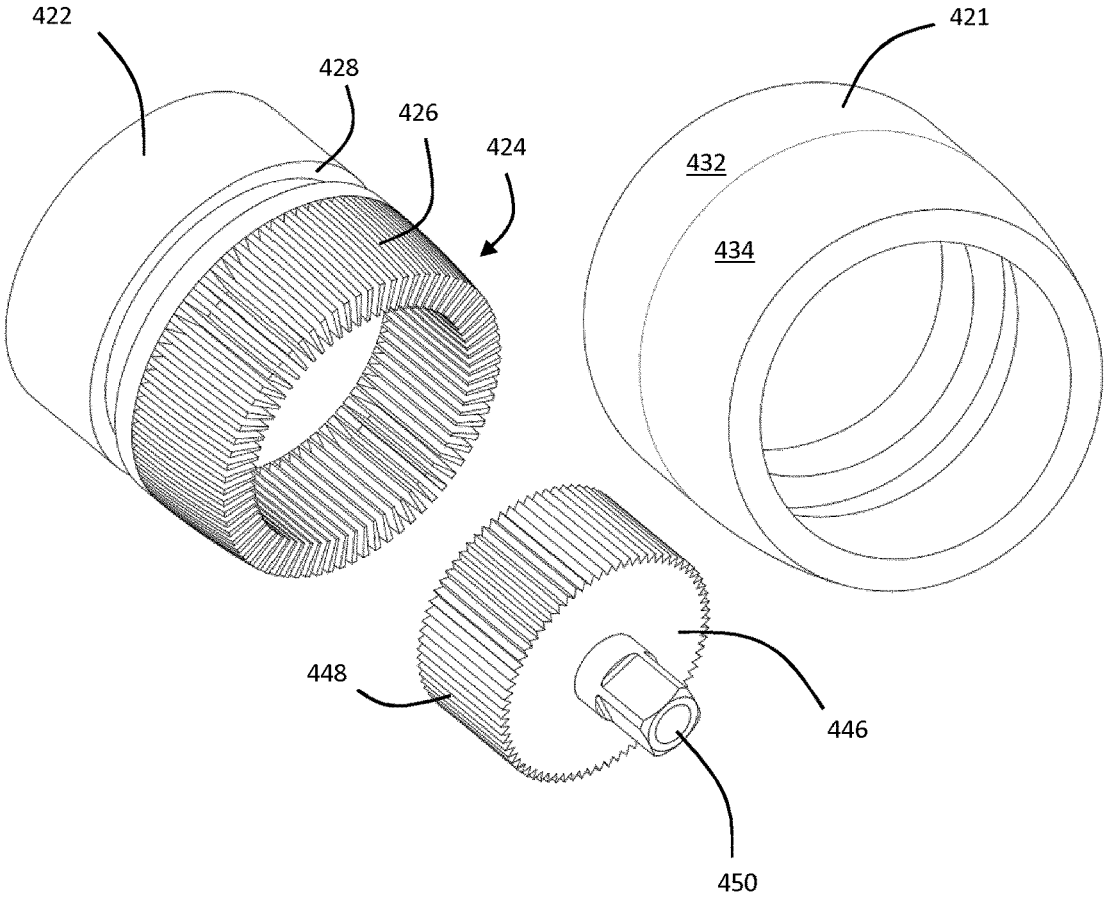
FIG. 20 is an exploded view of the subassembly of FIG. 19.

Referring to FIGS. 19 and 20 there is provided a ratchet 420 and a ratchet-engaging mechanism 416 as part of a locking mechanism subassembly 404.

The ratchet 420 has a cylindrical portion 446 defining a set of ratchet teeth 448 on a radially outwardly facing surface thereof. A first locking mechanism shaft 450 projects from a first side of the cylindrical portion 446.

The ratchet-engaging mechanism 416 comprises a ratchet-engaging member 418 and a collar 421.

The ratchet-engaging member 418 comprises a hollow, cylindrical shaft 422 having a ratchet-engaging formation 424 defined at a first end. The ratchet-engaging formation 424 comprises a plurality of axially extending flexible tooth members 426. The tooth members 426 have tapered radially outwardly facing edges 430. The radially outwardly facing edges 430 of the tooth members 426 taper radially inwardly away from the shaft 422. A shoulder 428 is defined on the outer surface of the shaft 422 facing the tooth members 426.

The collar 421 comprises a hollow, cylindrical shaft 432 and a curved, frustroconical tapered region 434 extending therefrom. The curved, frustroconical tapered region 434 tapers radially inwardly away from the shaft 432.

The ratchet-engaging member 418 and a collar 421 are rotationally fixed but linearly moveable relative to each other via e.g. a spline 436 (visible only in FIG. 19).

Assembly

The ratchet 420 is generally rotationally fixed to one of the antenna bracket and pole mount (as discussed above). The ratchet-engaging mechanism 416 is attached to the other. The ratchet 420 is inserted into the ratchet-engaging member 418 such that the teeth of the former 448 face the tooth members 426 of the outer (although they are not engaged—see FIG. 19). The collar 421 is assembled to the ratchet-engaging member 418 via the spline 436.

The ratchet 420 can rotate freely relative to the ratchet-engaging mechanism 416 in this mode (i.e. the rotatable condition).

When it is desired to lock the antenna, the collar 421 is moved axially in direction D such that the tapered region 434 radially inwardly deforms the flexible tooth members 426. This forces them into engagement with the ratchet teeth 448 to fix the ratchet 420 relative to the ratchet-engaging mechanism 416. This is the locked condition.

The Fifth Embodiment

Structure

Figure 21:
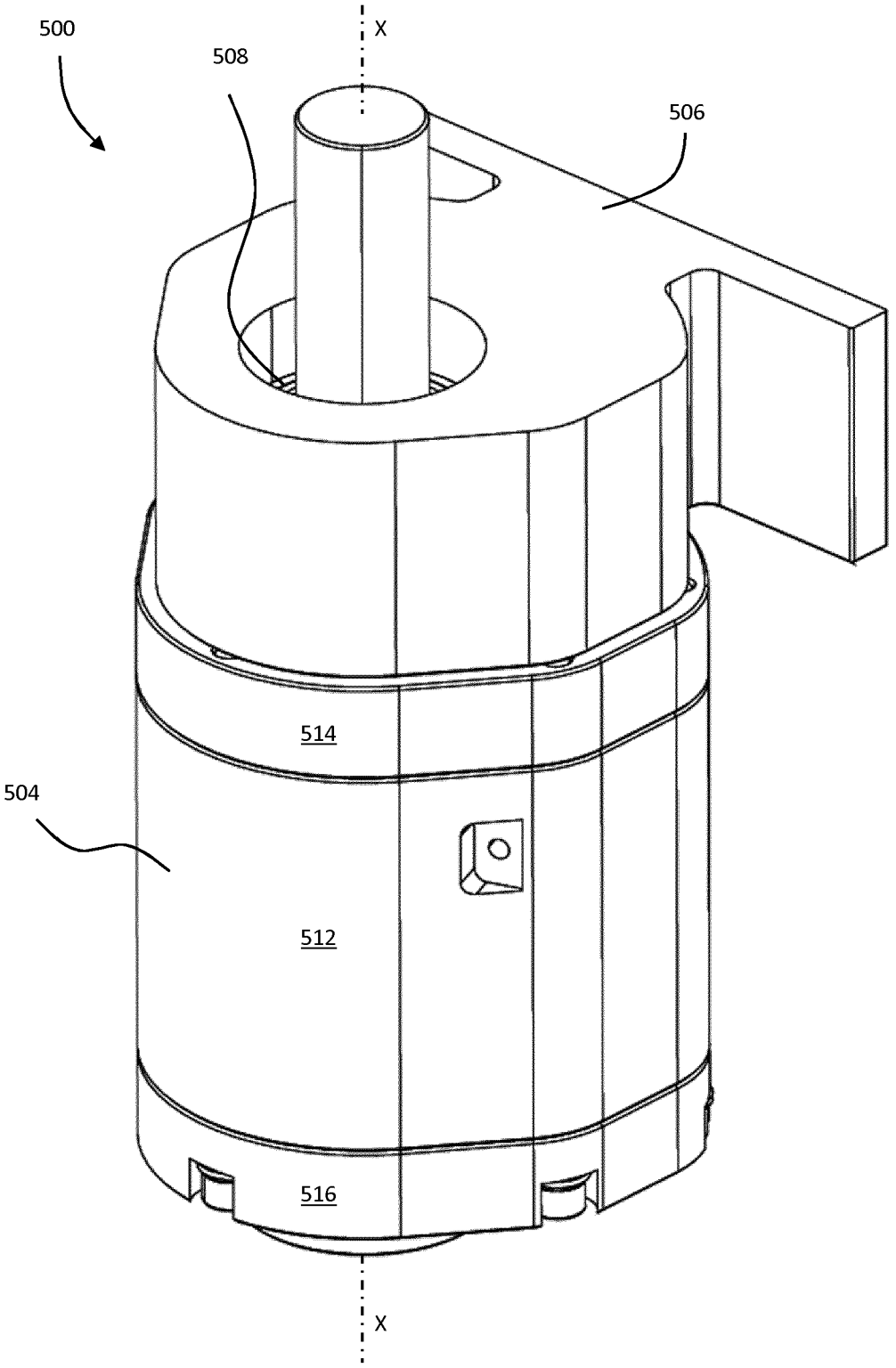
FIG. 21 is a perspective view of a fifth antenna steering and locking apparatus according to the invention.

Referring to FIG. 21 certain sub-assemblies of a fifth steering and locking apparatus 500 are shown, specifically:

A locking mechanism subassembly 504;

A first mounting subassembly 506; and,

A bearing subassembly 508.

The first mounting subassembly 506 and bearing subassembly 508 are similar to those of the first and second embodiments and will not be described in detail. It should also be noted that a second mounting subassembly, being pivotable about the first mounting subassembly 506 via the bearing subassembly 508 but is not shown.

Locking Mechanism Subassembly 504

The locking mechanism subassembly 504 comprises a housing 512 having a first end plate 514 and a second end plate 516.

Figure 22:
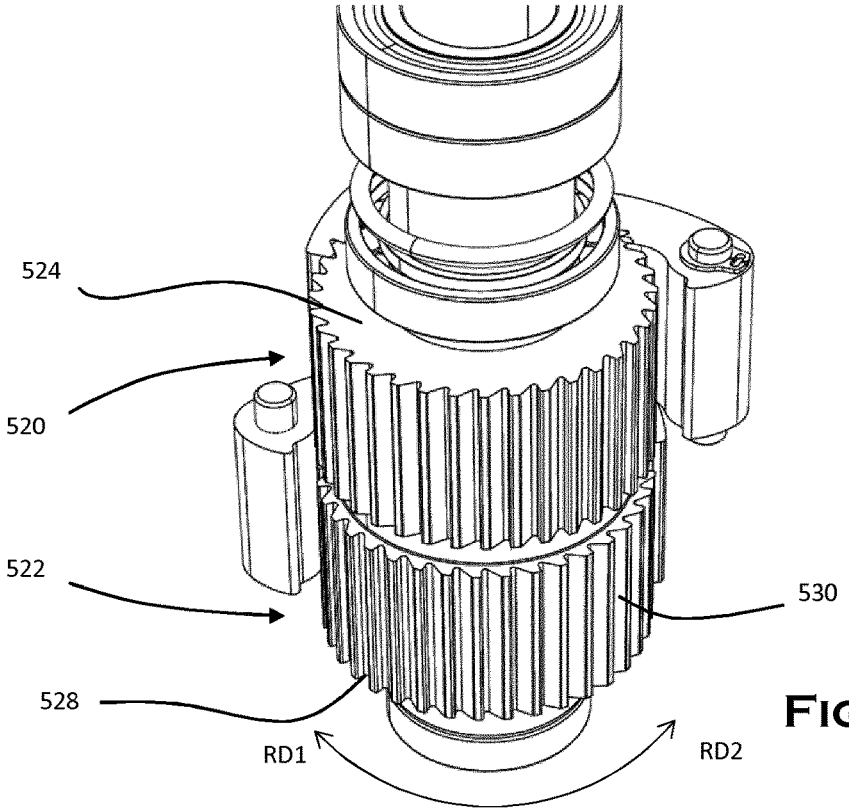
FIGS. 22 and 23 are views of the antenna steering and locking apparatus of FIG. 21 with various components removed.
Figure 23:
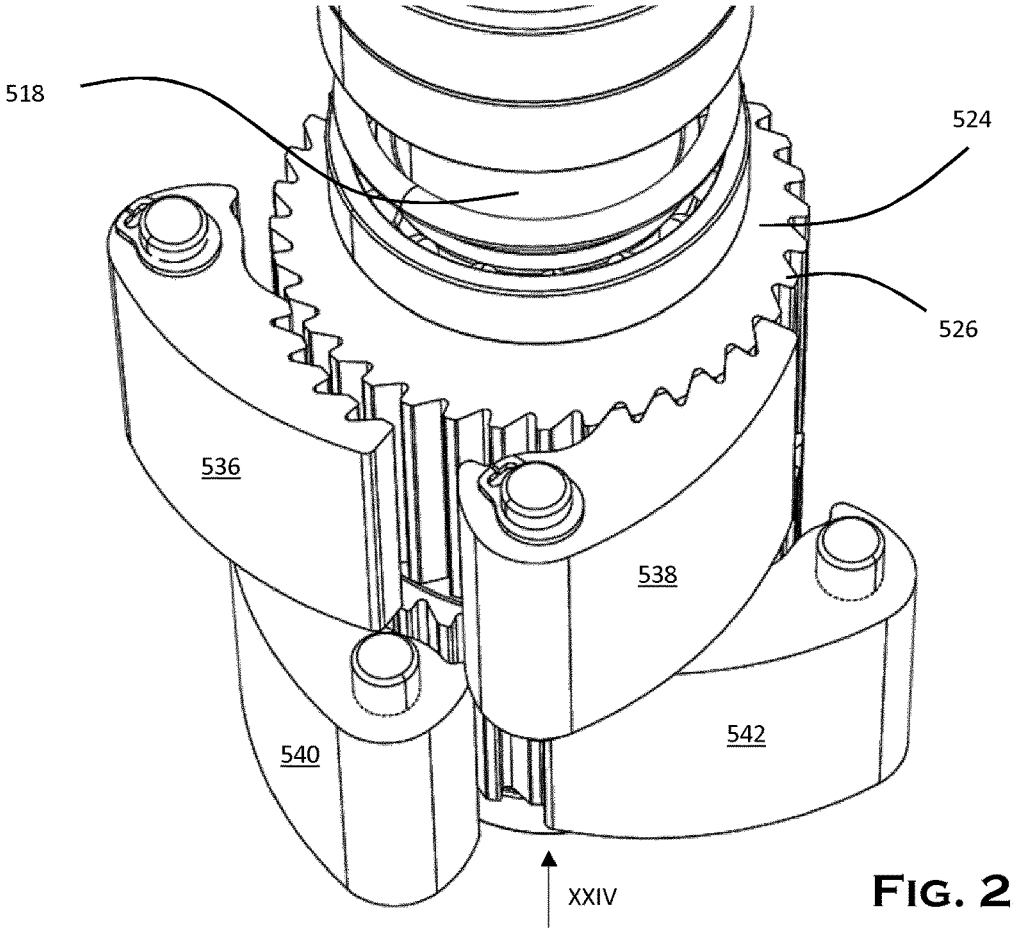

Referring to FIGS. 22 and 23, encapsulated within the housing 512 there is provided a central shaft 518 rotatable on an azimuth steering axis X. This shaft is, in use, coupled to the pivot shaft of the second mounting subassembly, and rotates therewith relative to the first mounting subassembly 506 as with the first and second embodiments.

Two ratchets 520, 522 are mounted on the shaft. The ratchets 520, 522 are mounted adjacent one another along the shaft 518. The ratchet 520 has a cylindrical portion 524 defining a set of ratchet teeth 526 on a radially outwardly facing surface thereof. The ratchet 522 has a cylindrical portion 528 defining a set of ratchet teeth 530 on a radially outwardly facing surface thereof.

Figure 24:
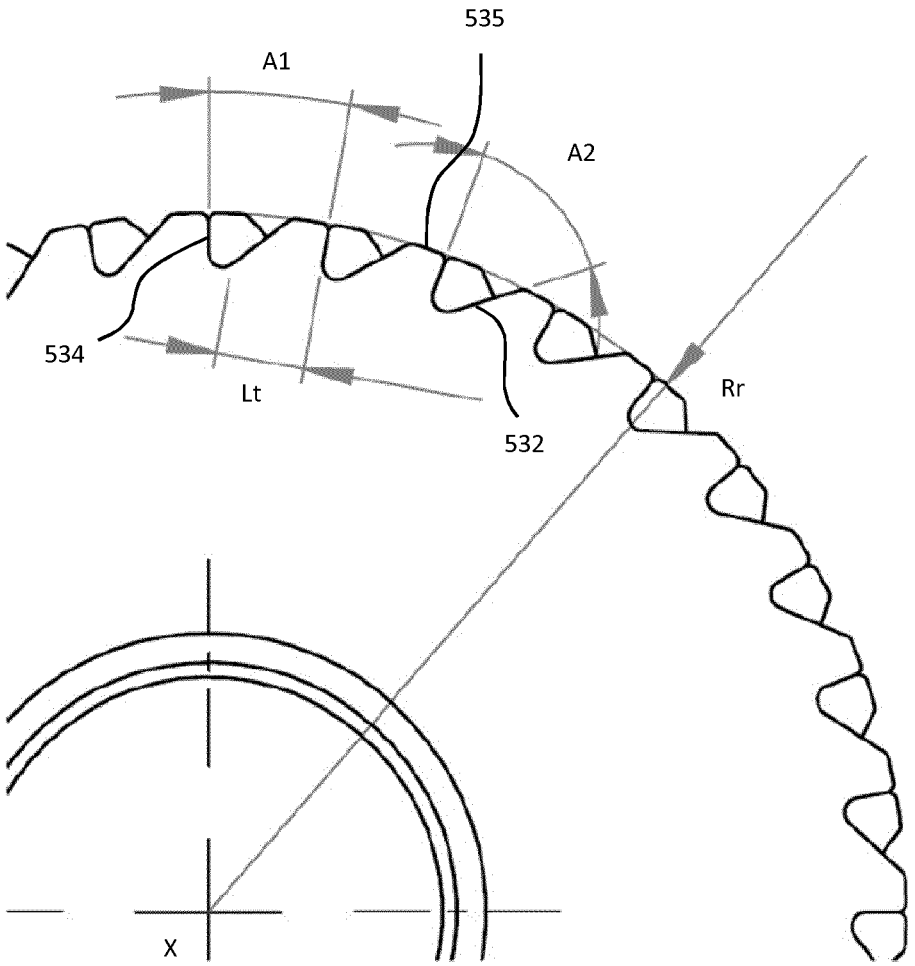
FIG. 24 is a detail view of a part of the antenna steering and locking apparatus of FIG. 21.

Referring to FIG. 24, the teeth 526, 530 of the ratchets 520, 522 are shown in detail, viewed in direction XXIV in FIG. 23. The ratchet 522 (and hence teeth 530) are in the foreground. Each tooth 530 is angle A1 apart, meaning there are $$N = \frac{360}{A1}$$

teeth. In this embodiment A1=10 degrees, meaning there are N=36 teeth. Each tooth 530 has a raked face 532, a radial face 534 and a flat, generally circumferential end face 535. The internal angle A2 between the raked face and radial face is 52.72 degrees in this embodiment. Each tooth has a length Lt of 3.05 mm. The ratchets 520, 522 have a radius of 23.85 mm in this embodiment.

It will be noted that (referring to FIGS. 22 and 23) the teeth 526 of the ratchet 520 face in a first rotational direction RD1, whereas the teeth 530 of the ratchet 522 face in the opposite rotational direction RD2. The rotational direction is the direction in which the radial faces 534 face.

Four pawls 536, 538, 540, 542 are provided within the housing 512. Two pawls 536, 538 are associated with the first ratchet 520, and two pawls 540, 542 are associated with the second ratchet 522.

Figure 25:
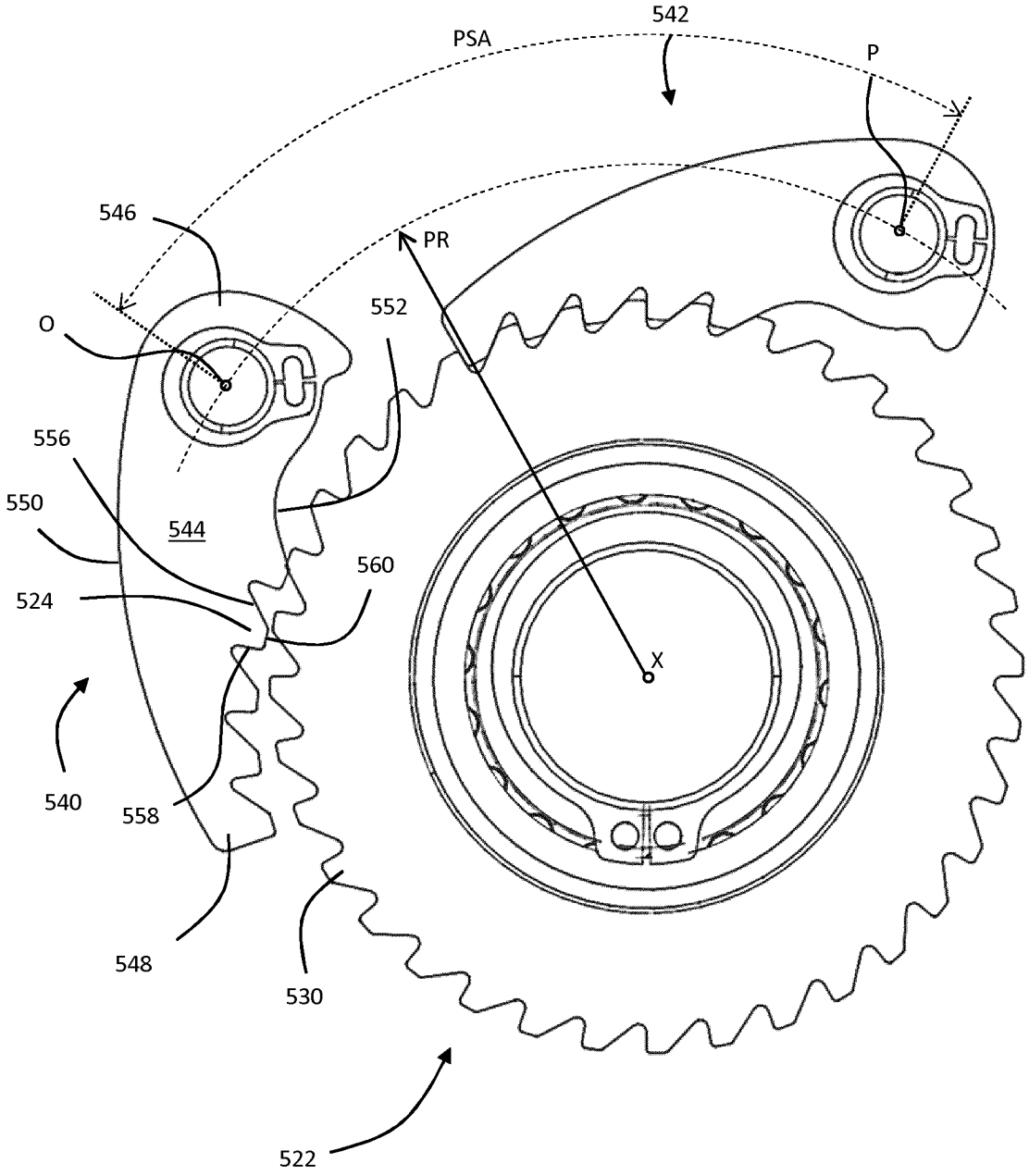
FIG. 25 is an end view of a part of the antenna steering and locking apparatus of FIG. 21.

Referring to FIG. 25, the second ratchet 522 is shown with the pawls 540, 542. The pawls 540, 542 are identical, and as such only the pawl 540 will be described in detail. The pawl 540 comprises a generally prismatic body 544 tapering inwardly from a mounted end 546 to a free end 548. The pawl defines a convex sidewall 550 and a concave sidewall 552. The concave sidewall 552 defines a plurality of (in this case five) teeth 554. Each tooth 554 has a is angle A1 apart. Each tooth 554 has a raked face 556, a radial face 558 and a flat, generally circumferential end face 560. The internal angle A2 between the raked face and radial face is 52.72 degrees in this embodiment. Each tooth has a length Lt of 3.05 mm. The concave face 552 of the pawl 540 has a radius of 23.85 mm in this embodiment. As a result, the teeth are complementary and engageable with the teeth 530 of the ratchet 522. Referring to the pawl 542, it is shown engaged with the ratchet 522.

The pawls 540, 542 are mounted on respective pawl axes O and P for rotation thereabout. Axes 0 and P are parallel to the steering axis X, and both disposed at a common pawl radius PR from the axis X. Each pawl 540, 542 is biased into engagement with the ratchet 522.

The pawls 540, 542 are, as discussed above, circumferentially spaced about the axis X. The pawl positions are selected such that, given N teeth of angle A1 apart, the pawl 540 fully engages at every A1 degrees (i.e. in this embodiment, every 10 degrees). The pawl 544 is positioned apart from the pawl 540 by angle $$PSA = (M \cdot A1) + \frac{A1}{2}$$

degrees, where M is an integer. In other words, the pawl 542 is positioned at a phase offset of $$\frac{A1}{2}$$

degrees. In this embodiment, PSA=85 degrees, and $$\frac{A1}{2} = 5.$$

This means that the ratchet 522 is fully engaged (and prevented from being backdriven) every 5 degrees. In other words, the ratchet "resolution" is 5 degrees, even though the teeth are 10 degrees apart.

The pawls 536, 538 are identical to the pawls 540, 542, although facing in the opposite circumferential direction about the first ratchet 520. Each of the first pair of pawls 536, 538 is positioned to be "in phase" (i.e. simultaneously fully engaged with its respective ratchet at a given rotational position of the shaft 518) with a respective one of the second pair of pawls 540, 542.

Each of the pawls can be retracted from engagement with the respective ratchets. Although not shown in detail, it will be understood that means are provided for rotating each pawl about its pawl axis to move the teeth out of engagement with the ratchet teeth, thus permitting rotational movement of the ratchet in the otherwise locked rotational direction.

Assembly

The ratchets 520, 522 and pawls 536, 538, 540, 542 are mounted and encapsulated and sealed within the housing 512.

Function

The locking mechanism subassembly 504 has a fully locked condition in which all four pawls are released under bias to contact the respective ratchet (FIGS. 22-25). In this embodiment, the pawls 538 and 542 are fully engaged with the ratchets 520, 522 respectively. The engagement of the pawl 538 with the ratchet 520 inhibits rotation in the direction RD1. The engagement of the pawl 542 with the ratchet 522 inhibits rotation in the direction RD1. The shaft 518 is therefore unable to rotate.

In order to steer the cellular antenna, in a first method, all four pawls are moved to the released position (i.e. out of contact with the respective ratchets). The shaft 518 can then be rotated to the desired position and the pawls released to lock the shaft 518.

In a second, alternative method, only the pawls 536, 538 may be released, allowing the shaft 518 to be steered in direction RD1. The resiliently biased pawls 540, 542 "ride over" the teeth of the ratchet at the shaft 518 is rotated, but also inhibit reserve rotation in direction RD2. Similarly, only the pawls 540, 542 may be released for rotation in direction RD2.

It will be noted that in this embodiment, the shaft can be rotated by 360 degrees and locked in 5 degree increments. In practice, cellular antennas are only rotated by ±60 degrees at most.

In a modification to the above embodiment, the pawls 536, 538, 540, 542 may be electrically moved by e.g. an electromechanical actuator or solenoid. A controller may be provided to undergo the operational steps discussed above, including a step of rotating the antenna with an electric motor.

In a further modification, a third pawl may be provided with each ratchet. The third pawl may have a phase offset of $$\frac{A1}{4}$$

degrees, providing (in this embodiment) 2.5 degrees of resolution.

The Sixth Embodiment

Structure

Figure 26:
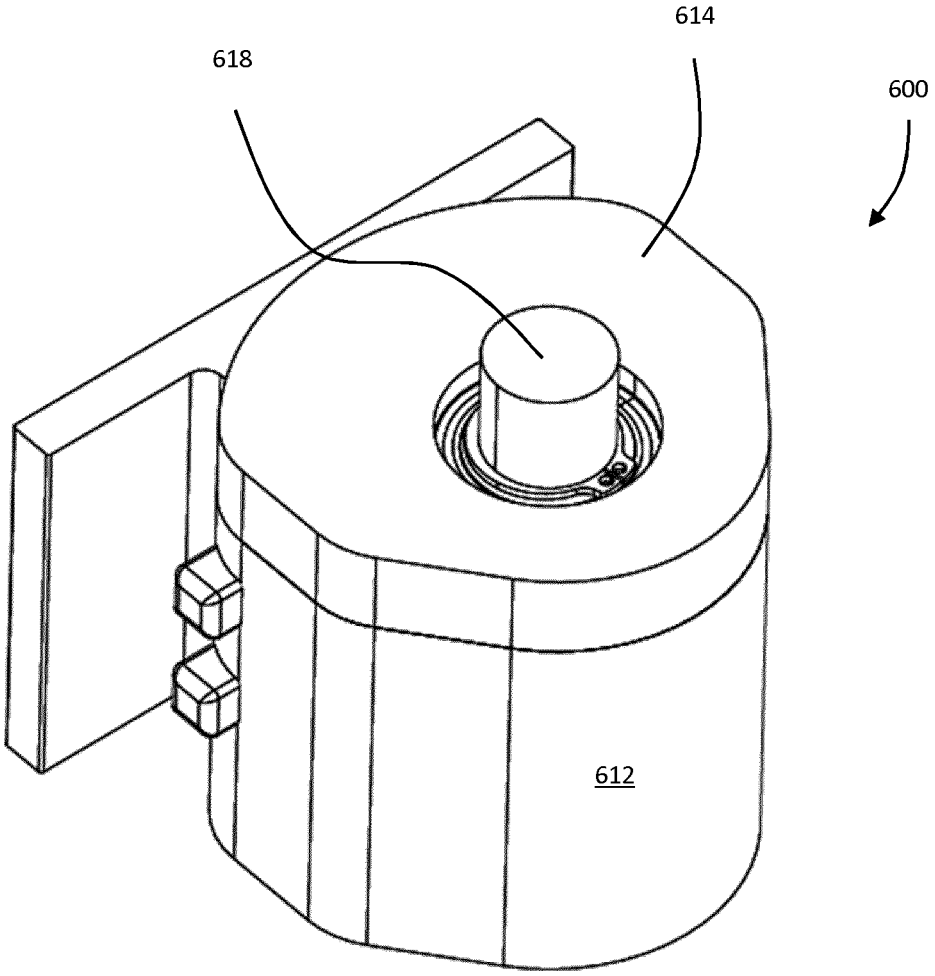
FIG. 26 is a perspective view of a sixth antenna steering and locking apparatus according to the invention.

Referring to FIG. 26, a locking mechanism subassembly 604 of a sixth steering and locking apparatus 600 is shown.

The locking mechanism subassembly 604 is for use with a first mounting subassembly and bearing subassembly similar to those of the first and second embodiments (which will not be described in detail).

Locking Mechanism Subassembly 604

The locking mechanism subassembly 604 comprises a housing 612 having an end plate 614. A central shaft 618 is provided for attachment to a mounting subassembly of an antenna steering apparatus.

Figure 27:
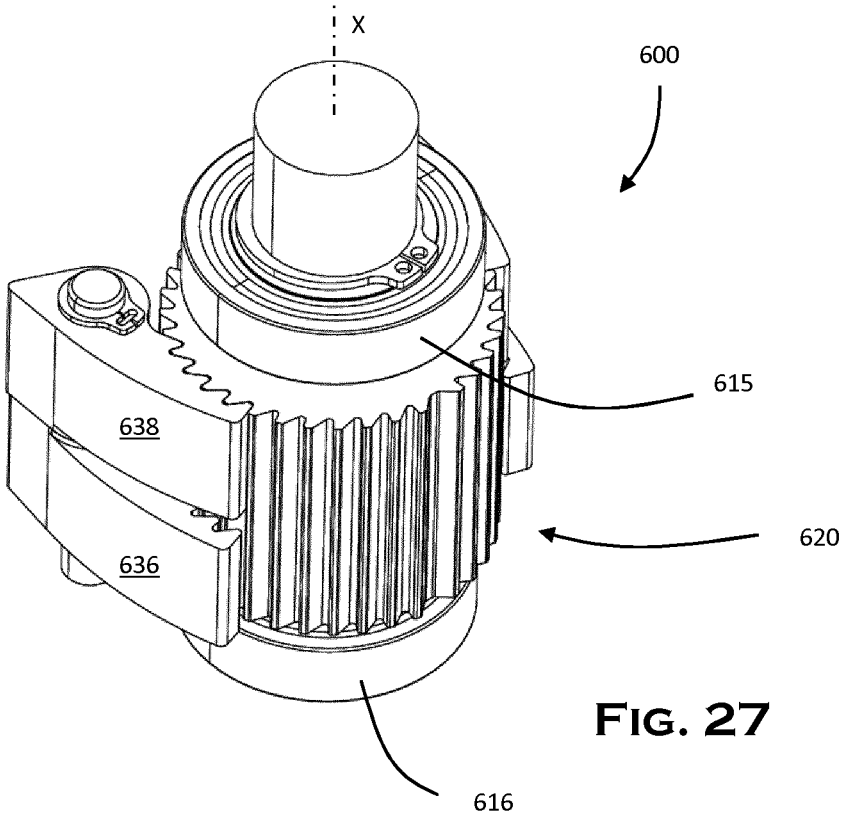
FIGS. 27 and 28 are views of the antenna steering and locking apparatus of FIG. 26 with various components removed.
Figure 28:
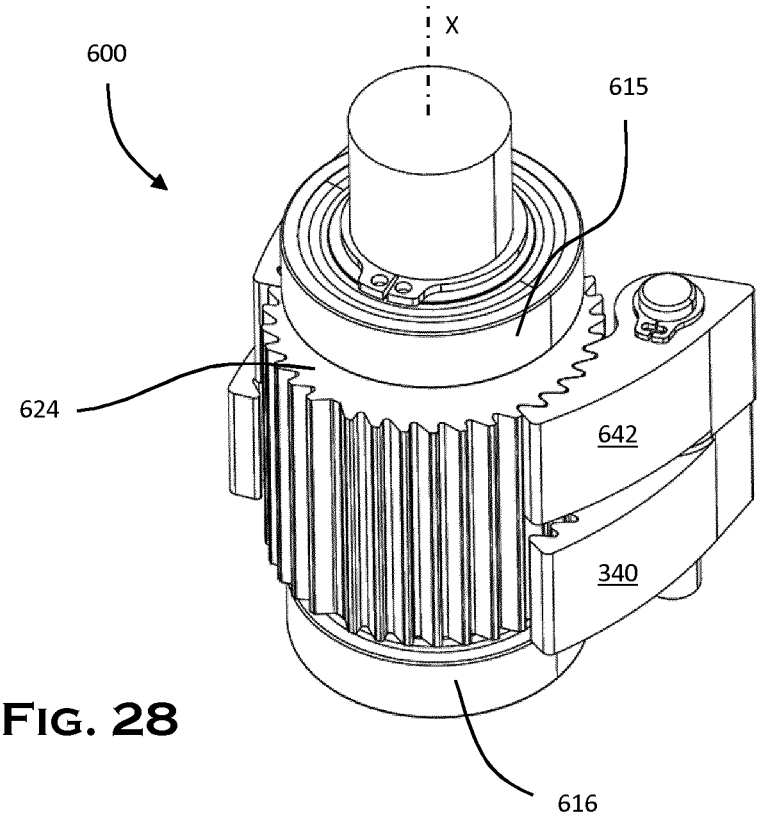

Referring to FIGS. 27 and 28, encapsulated within the housing 612 the central shaft 618 is mounted on a first bearing 615 and a second bearing 616, so as to be rotatable on an azimuth steering axis X.

A ratchet 620 is mounted on the shaft 618. The ratchet 620 has a cylindrical portion 624 defining a first set of ratchet teeth 626 and a second set of ratchet teeth 628 on a radially outwardly facing surface thereof. Each set of teeth extend along the axial width of the ratchet 620 by the same distance, but cover only half of the perimeter each. In other words, each set of ratchet teeth 626, 628 cover 180 degrees (or a respective semi-cylindrical surface) of the ratchet 620.

Figure 30:
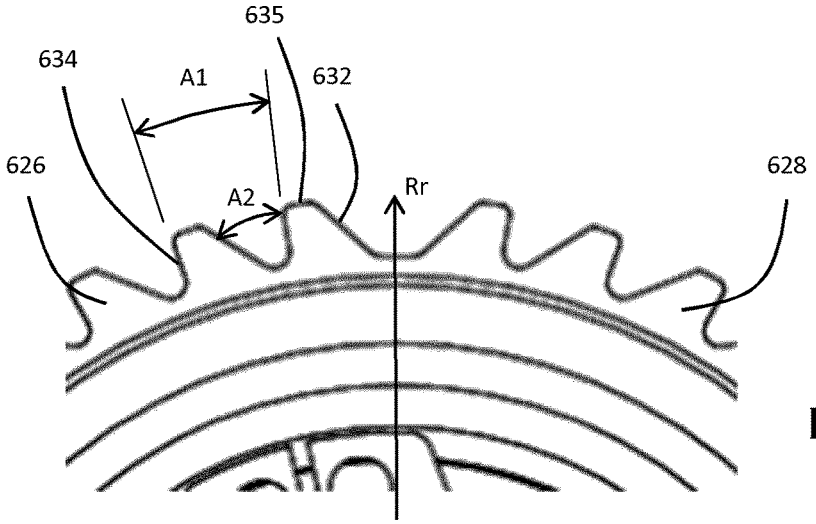
FIG. 30 is a detailed view of a portion of FIG. 29.

Referring to FIG. 30, the teeth 626, 628 of the ratchet 620 are shown in detail.

The teeth 626 are an angle A1 apart. In this embodiment A1=10 degrees, and there are 17 teeth 626. Each tooth 626 has a raked face 632, a radial face 634 and a flat, generally circumferential end face 635. The internal angle A2 between the raked face and radial face is 52.72 degrees in this embodiment. Each tooth has a length Lt of 3.05 mm. The ratchet 620 has a radius Rr of 23.85 mm in this embodiment.

The teeth 628 are identical to the teeth 626 except for the fact that the face in the opposite direction—i.e. referring to FIG. 30, the teeth 626 face in direction RD1, and the teeth 628 in direction RD2.

Four pawls 636, 638, 640, 642 are provided within the housing 512. Two pawls 636, 638 are associated with the first set of teeth 626, and two pawls 640, 642 are associated with the second set of teeth 628. The pawls 636, 638 are mounted on a first common pawl shaft 639 for rotation relative to each other about a first pawl axis Q, and the pawls 640, 642 are mounted on a second common pawl shaft 643 for rotation about a second pawl axis R. Both axes Q, R are parallel to the steering axis X, and both disposed at a common pawl radius PR from the axis X. Each pawl is biased into engagement with the ratchet 620.

The pawls 636, 638, 640, 642 are similar to each other. The pawls 636, 640 are identical, and the pawls 640, 642 are identical.

The pawl 636 comprises a generally prismatic body 644 tapering inwardly from a mounted end 646 to a free end 648. The pawl defines a convex sidewall 650 and a concave sidewall 652. The concave sidewall 652 defines a plurality of (in this case five) teeth 654. Each tooth 654 has a is angle A1 apart. Each tooth 654 has a raked face 656, a radial face 658. The internal angle A2 between the raked face and radial face is 52.72 degrees in this embodiment. Each tooth has a length Lt of 3.05 mm. The concave face 652 of the pawl 640 has a radius of 23.85 mm in this embodiment. As a result, the teeth are complementary and engageable with the teeth 626 of the ratchet 620. Referring to the pawl 636, it is shown engaged with the ratchet 620.

Figure 31:
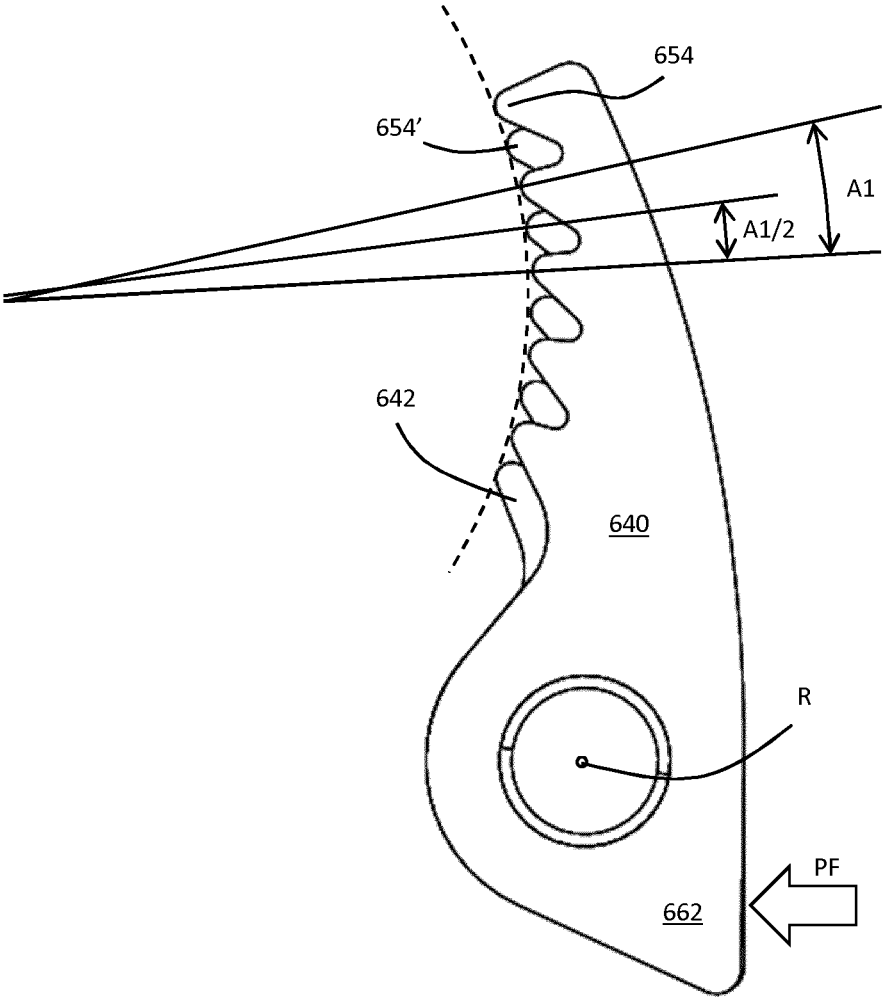
FIG. 31 is a view of a subset of component of the steering and locking apparatus of FIG. 26.

Referring to FIG. 31, the pawls 640, 642 are shown at the same angular position. As can be seen, the teeth 654 of the pawl 640 are phase offset compared to the teeth 654' of the pawl 642. As discussed, each tooth 654 on the pawl 640 are A1 degrees apart (i.e. about the geometric centre of the concave face/steering axis X). It will be noted that the teeth 654' of the pawl 642 are also A1 degrees apart, but offset by $$\frac{A1}{2}$$

degrees. This provides the same effect as the phase offset pawls of the fifth embodiment—i.e. to provide a higher resolution.

The pawls are therefore configured such that, given ratchet teeth of angle A1 apart, one of the pawls fully engages at every $$\frac{A1}{2}$$

degrees (i.e. in this embodiment, every 5 degrees.

The pawls 636, 638 are identical to the pawls 640, 642, although facing in the opposite circumferential direction about the ratchet 620, and engaging respective sets of teeth.

Each of the pawls 636, 638, 640, 642 is resiliently biased into engagement with the ratchet by e.g. a spring or other similar mechanism.

Each of the pawls can be retracted from engagement with the respective ratchets. Although not shown in detail, it will be understood that means are provided for rotating each pawl about its pawl axis to move the teeth out of engagement with the ratchet teeth, thus permitting rotational movement of the ratchet in the otherwise locked rotational direction. As shown in FIG. 31 in particular, an abutment 662 extends to an opposite side of the pawl axis R, and a force PF on the pawl is applied to rotate it against the bias out of engagement with the ratchet. The force PF may be applied via manual means (e.g. a button) or by an electromechanical actuator or solenoid.

Function

Figure 29:
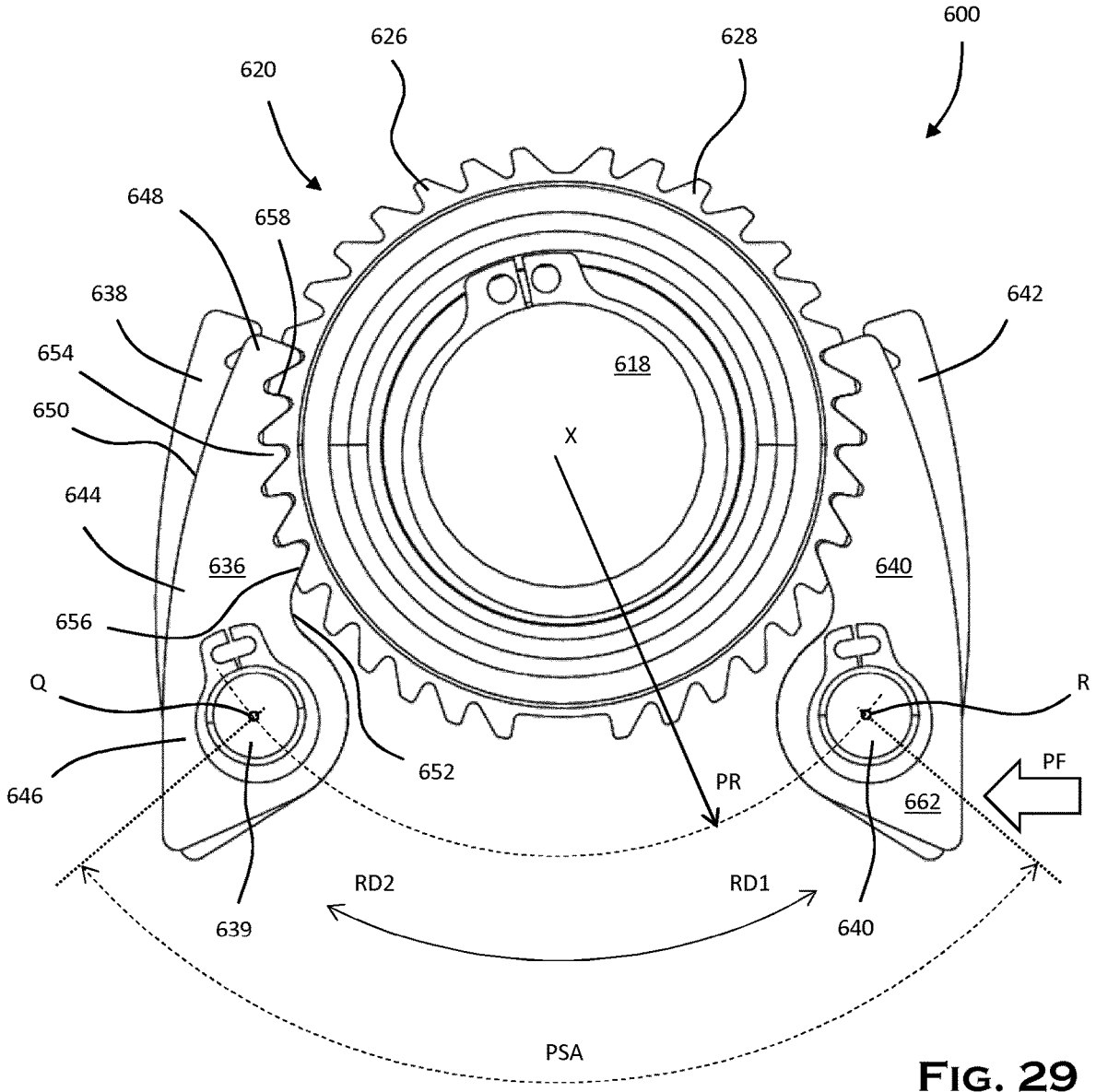
FIG. 29 is an end view of a part of the antenna steering and locking apparatus of FIG. 26.

The locking mechanism subassembly 604 has a fully locked condition in which all four pawls are released under bias to contact the respective ratchet (FIG. 29). In this embodiment, the pawls 636 and 640 are fully engaged with the ratchet 620. The engagement of the pawl 636 with the ratchet 620 inhibits rotation in the direction RD1. The engagement of the pawl 640 with the ratchet 620 inhibits rotation in the direction RD2. The shaft 618 is therefore unable to rotate.

In order to steer the cellular antenna, in a first method, all four pawls are moved to the released position (i.e. out of contact with the respective ratchets) by applying forces PF. The shaft 618 can then be rotated to the desired position and the pawls released to lock the shaft 618.

In a second, alternative method, only the pawls 636, 638 may be released, allowing the shaft 618 to be steered in direction RD1. The resiliently biased pawls 640, 642 "ride over" the teeth of the ratchet as the shaft 618 is rotated, but also inhibit reserve rotation in direction RD2. Similarly, only the pawls 640, 642 may be released for rotation in direction RD2.

It will be noted that in this embodiment, the shaft can be rotated by ±60 degrees at most.

A controller may be provided to undergo the operational steps discussed above, including a step of applying the force PF to the required pawls and rotating the antenna with an electric motor.

In a further modification, a third pawl may be provided on each side of the ratchet. The third pawl may be configured with a phase offset of $$\frac{A1}{4}$$

degrees, providing (in this embodiment) 2.5 degrees of resolution.

Variations

It will be noted that the provision of pawls at different, and phase offset circumferential positions per the fifth embodiment may be employed with the ratchet configuration of the sixth embodiment (noting that the pawls will still need to be axially adjacent for packaging reasons). Similarly, pawls which are positioned at the same circumferential position but with the phase offset effected by the configuration of the teeth (the sixth embodiment) may be used with e.g. the fifth embodiment. What is important is that the pawls are provided having a phase offset.

Clamping Mechanisms

Figure 32:
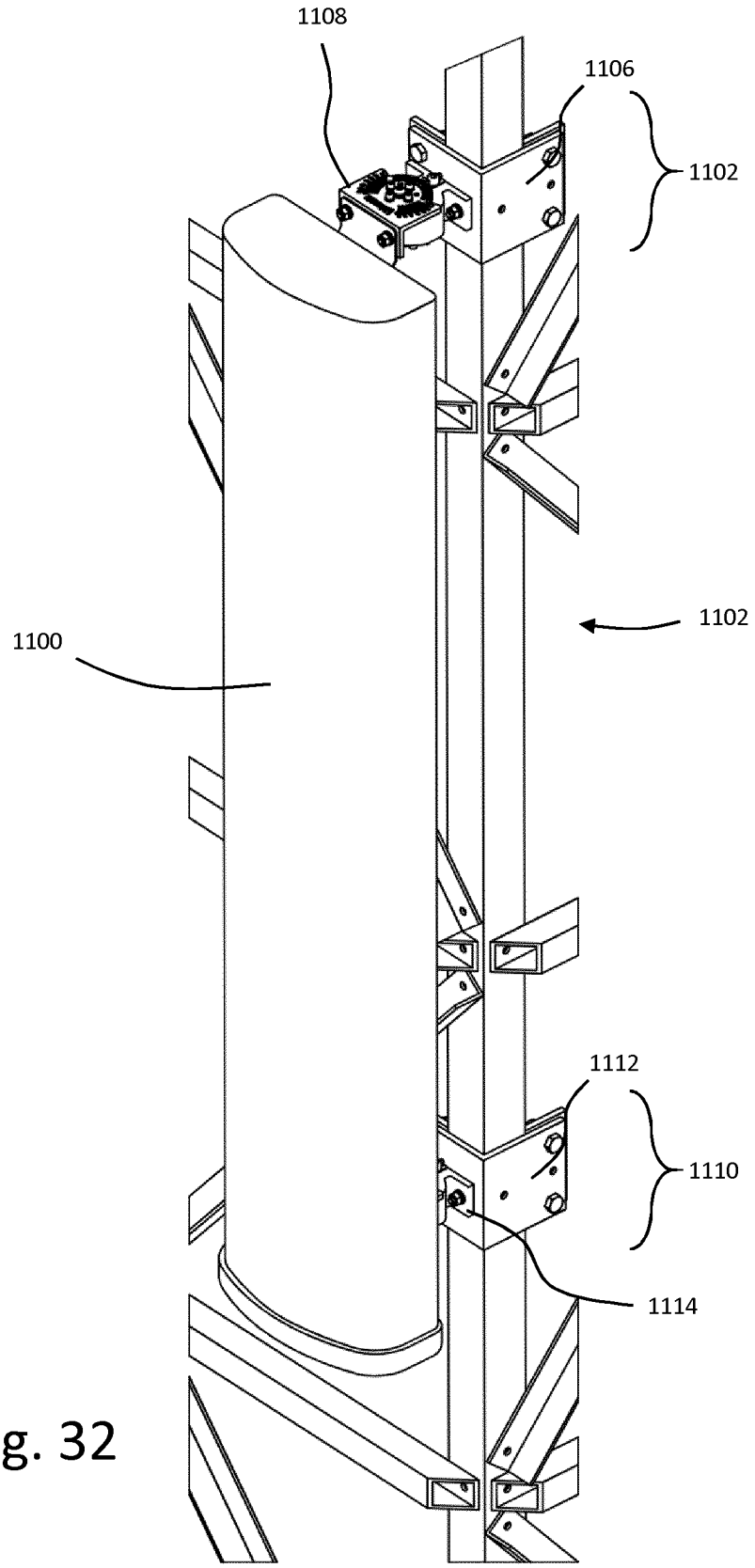
FIG. 32 is a perspective view of a cellular antenna attached to a mast using two of a first mounting assembly according to the present invention.

FIG. 32 onwards show four different types of clamp mechanism which can be used to attach the steering and locking apparatuses 100, 200, 300, 400, 500, 600 to a mast. Each clamp is configured for attachment to different types of mast component as follows:

- Clamp 1106 (FIGS. 32 to 37) for attachment to a right-angle section;
- Clamp 1206 (FIGS. 38 to 41) for attachment to a square section;
- Clamp 1306 (FIGS. 42 to 43) for attachment to a circle section; and,
- Clamp 1406 (FIGS. 44 to 45) for attachment to a horizontal square section.

The traditional antenna mounting system is shown in FIG. 1. The pole 20 is typically attached to the mast via a pair of antenna supports, which are usually in the form of a pair of vertically spaced-apart, horizontal supports. This has several drawbacks.

Firstly, the antenna supports and pole are all metal components (typically steel) and add considerable weight load to the mast.

Secondly, because the pole needs to be spaced-apart from the mast to allow access by the riggers, the supports create a moment arm for wind loads on the antenna. As such, the mast is put under greater stress from wind loading.

Thirdly, both part and installation cost is high with this approach, as several components need to be manufactured and assembled.

Fourthly, the supports require holes to be drilled in the mast, which is undesirable and time consuming.

The following mechanisms seek to mitigate these problems, and thereby present a suitable mounting arrangement for the steering and locking mechanisms mentioned in the present application. In particular, the combination of the ratchet arrangements hereinbefore described with the following clamp concepts reduce the risk of wind loads moving the antennas out of position. They also facilitate easier set up and positioning.

Clamp 1106 (FIGS. 32 to 37) for Attachment to a Right-Angle Section

Referring to FIGS. 32 to 37, an antenna 1100 is attached to a mast 1102 via a first mounting assembly 1104 comprising a first clamp 1106 and a first steering and locking apparatus 1108, and a second mounting assembly 1110 comprising a second clamp 1112 and a second steering steering and locking apparatus 1114.

Antenna

The antenna 1100 is a cellular antenna—that is an antenna configured to receive and transmit mobile telephone and data signals primarily for portable devices such as cellular phones, tablets, Mi-Fi devices etc. Such antennas are well known in the art, and will not be described in detail here.

Mast

Figure 34:
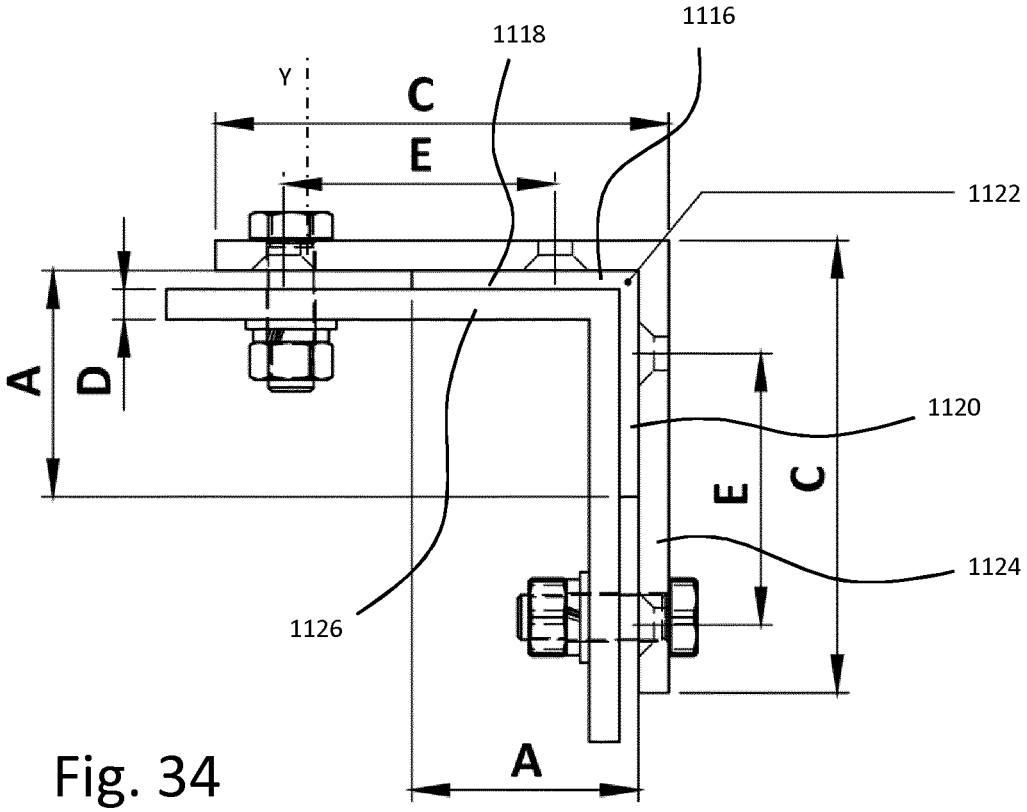
FIG. 34 is a plan view of the mounting clamp of FIG. 33.
Figure 35:
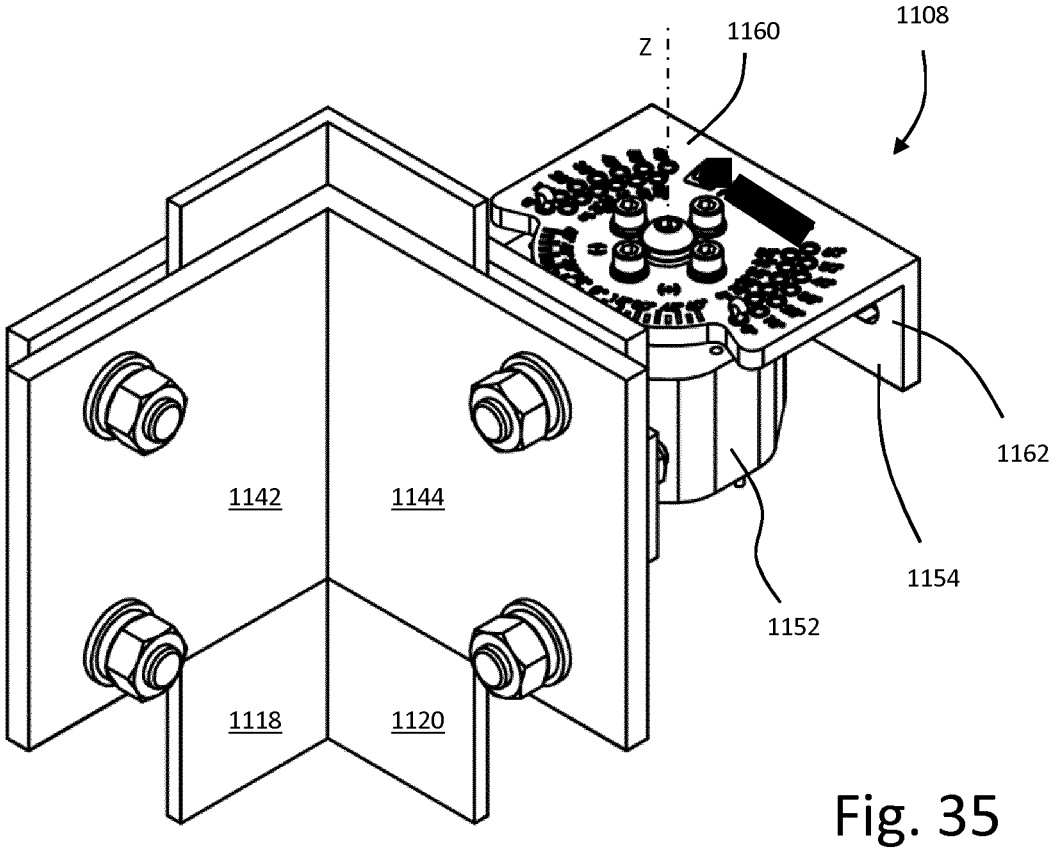
FIG. 35 is a perspective view of the mounting clamp of FIG. 33 in an installed condition.

The mast 1102 is also generally well-known in the art and comprises at least one upright or vertical member 1116 which is configured as an "L" shape in section, having a first leg 1118, second leg 1120 and an apex 1122 (FIG. 34). The vertical member 1116 is an integral, load-bearing part of the mast.

Referring to FIG. 34, each leg 1118, 1120 has an equal width A.

Clamps

The first clamp 1106 and second clamp 1112 are identical, and as such only the first clamp 1106 will be described here.

Figure 33:
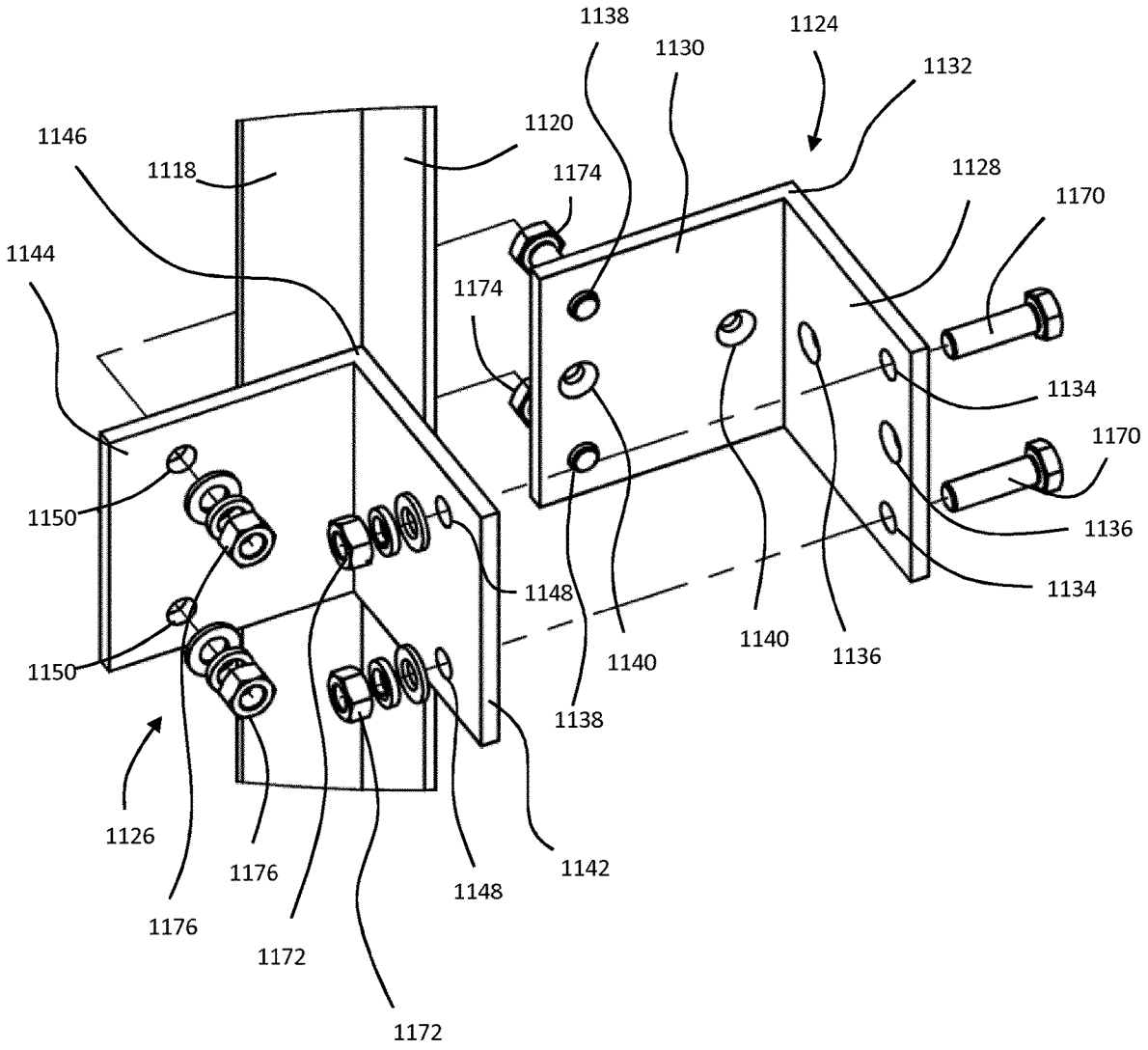
FIG. 33 is an exploded perspective view of a first mounting clamp of the first mounting assembly of FIG. 32.

Referring to FIG. 33, the first clamp 1106 comprises a mounting member 1124 and a clamp member 1126.

The mounting member 1124 is generally L-shaped in cross-section having a first leg 1128 and a second leg 1130. An apex 1132 is defined between the first and second legs 1128, 1130.

The first leg 1128 comprises two clamping bores 1134 spaced at the opposite end of the first leg 1128 to the apex 1132. The clamping bores 1134 are arranged vertically in use (i.e. parallel to the azimuth steering axis as defined below). The first leg 1128 further comprises two mounting bores 1136, which are arranged horizontally in use, with one proximate the apex, and one midway between the two clamping bores 1134. The mounting bores 1136 are countersunk, opening towards a concave (mast) side of the mounting member 1124.

The second leg 1130 is a mirror image of the first leg 1128. It comprises two clamping bores 1138 spaced at the opposite end of the first leg 1130 to the apex 1132. The clamping bores 1138 are arranged vertically in use (i.e. parallel to the azimuth steering axis as defined below). The first leg 1130 further comprises two mounting bores 1140, which are arranged horizontally in use, with one proximate the apex, and one midway between the two clamping bores 1138. The mounting bores 1140 are countersunk, opening towards a concave (mast) side of the mounting member 1124.

Referring to FIG. 34, each leg 1128, 1130 has a width C, and a distance between mounting bores 1136 of E.

The clamp member 1126 is generally L-shaped in cross-section having a first leg 1142 and a second leg 1144. An apex 1146 is defined between the first and second legs 1142, 1144.

The first leg 1142 comprises two clamping bores 1148 spaced at the opposite end of the first leg 1142 to the apex 1146. The clamping bores 1148 are arranged vertically in use (i.e. parallel to the azimuth steering axis as defined below).

The second leg 1144 comprises two clamping bores 1150 spaced at the opposite end of the second leg 1144 to the apex 1146. The clamping bores 1150 are arranged vertically in use (i.e. parallel to the azimuth steering axis as defined below).

The clamp member 1126 has a thickness D shown in FIG. 34.

Steering and Locking Apparatuses

The steering and locking apparatuses 1108, 1112 are identical. The steering and locking apparatuses comprise a locking subassembly according to the invention.

Installation

The first step is to attach one (or more) steering and locking apparatuses 1108 to the mounting member 1124. This is achieved by passing mechanical fasteners (bolts) from the concave (mast) side of the mounting member 1124, through the mounting bores 1136, and through aligned openings on the steering and locking apparatus 1108. Nuts are used to fasten the steering and locking apparatus 1108 to the mounting member 1124.

The second step is to attach the assembled steering and locking apparatus 1108 and mounting member 1124 to the mast 1102. This is achieved by clamping the mast member 1116 between the mounting member 1124 and the clamp member 1126 as shown in FIG. 33 (the steering unit 1108 is not shown for clarity). Mechanical fasteners in the form of bolts 1170 through the clamping bores 1134 and clamping bores 1148. Nuts 1172 are used to fasten the legs 1128, 1142 together. Mechanical fasteners in the form of bolts 1174 through the clamping bores 1138 and clamping bores 1150. Nuts 1176 are used to fasten the legs 1130, 1144 together. As such, the mast member 1116 is clamped or sandwiched between the mounting member 1124 and the clamp member 1126.

The same process is repeated for the second steering and locking apparatus 1114 and second clamp 1112, on the same mast member 1116 except axially offset from the first steering unit 1108 and first clamp 1106.

The antenna 1100 is then mounted to the respective antenna mounting flanges of the steering and locking apparatus 108, 112 as shown in FIG. 32.

Multiple Antennas

Figure 36:
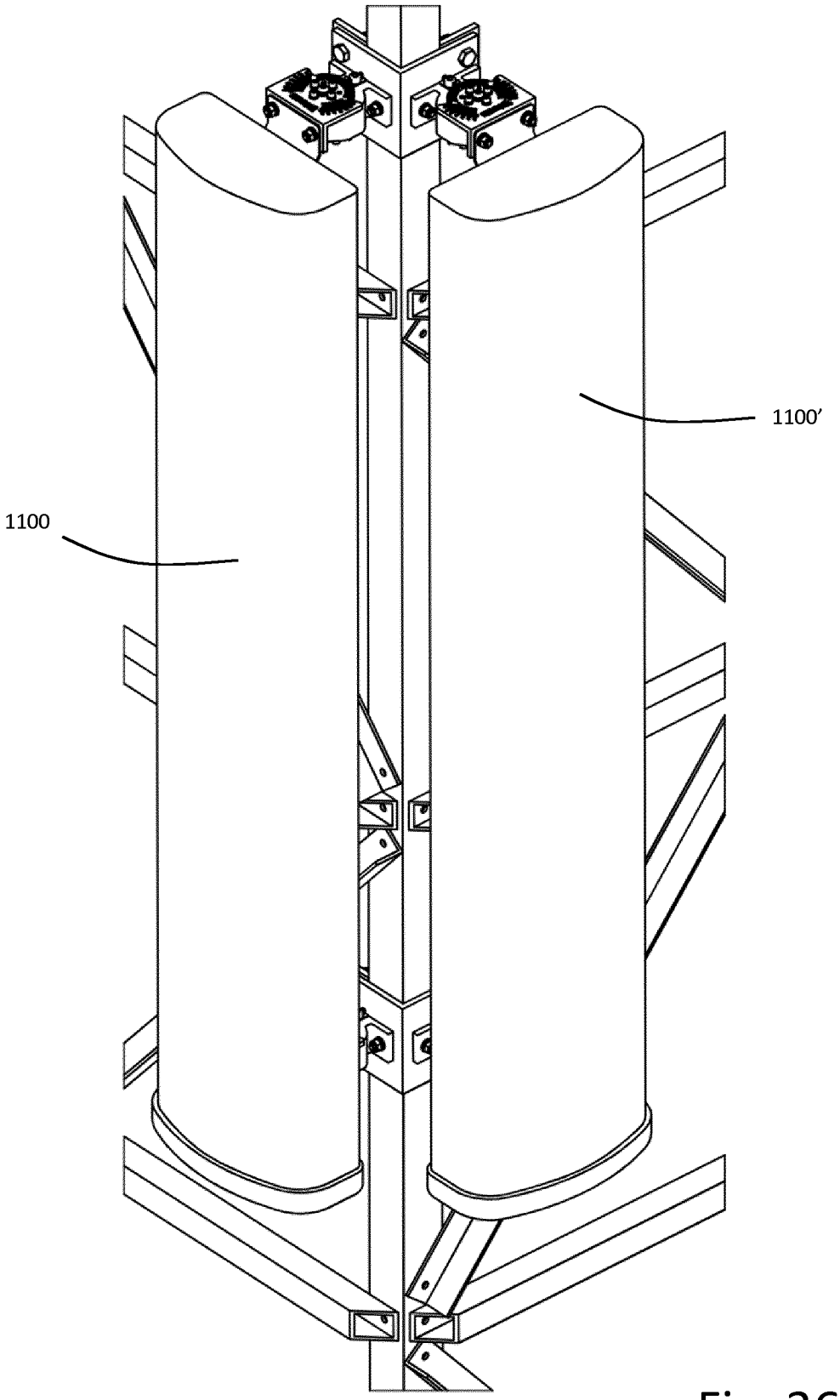
FIG. 36 is a perspective view of two cellular antennas to a mast using the mounting clamp of FIG. 32 and a steering unit.

As shown in FIG. 36, a further antenna 1100' can be attached to the second leg of the mounting member 1124, thus facing 90 degrees to the first (at zero steering angle).

Spacers

Figure 37:
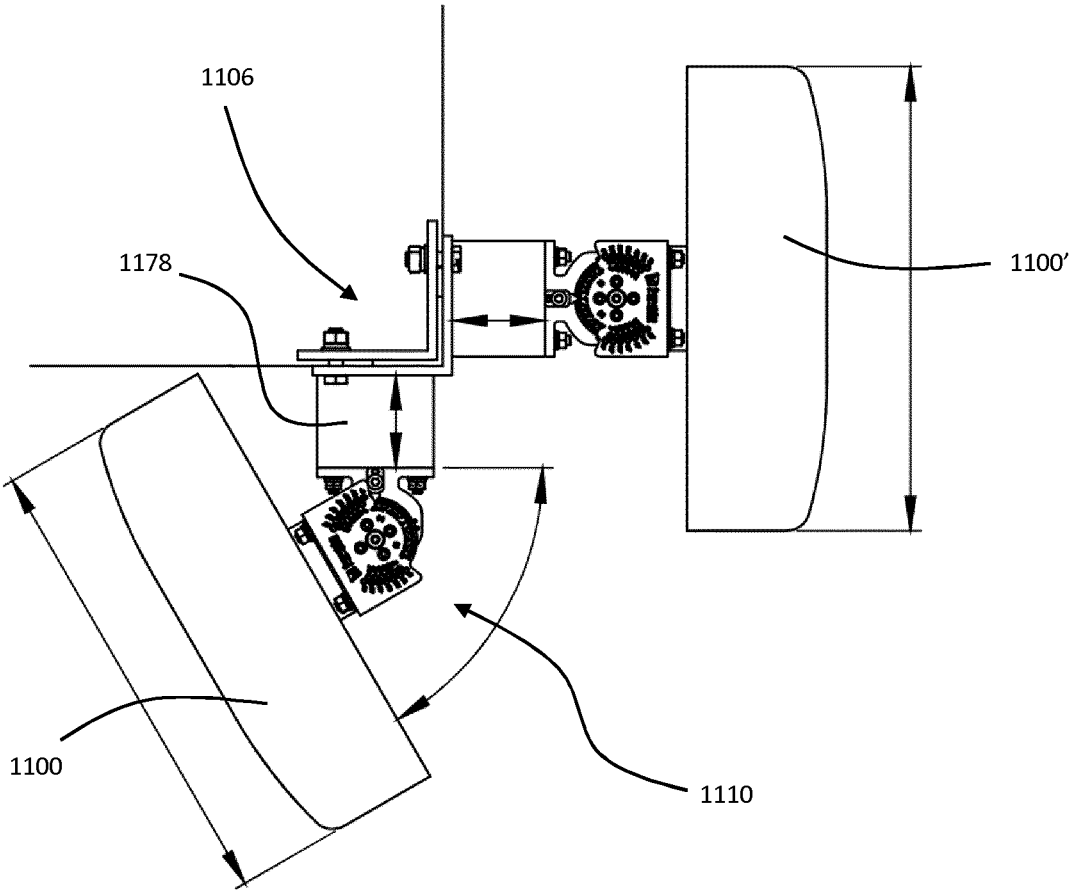
FIG. 37 is a plan view of an alternative configuration of the two cellular antennas of FIG. 36.

Referring to FIG. 37, in a further implementation of the invention, if it is desirable to provide more distance between the mast and the antenna 1100, a spacer 1178 may be positioned between the first clamp 1106 and the first steering and locking apparatus 1110. The spacer 1178 may be e.g. a tubular metal section.

It will be noted that the first embodiment relies exclusively on friction to hold the clamp on the mast member. There are no e.g. mechanical fasteners passing through apertures in the mast member to secure the clamp thereto. The fasteners holding the clamp together are all offset from the mast member, and all pass through the clamp members at an overlap/overhanging region of the clamp members relative to the mast member.

Clamp 1206 (FIGS. 38 to 41) for Attachment to a Square Section

Figure 38:
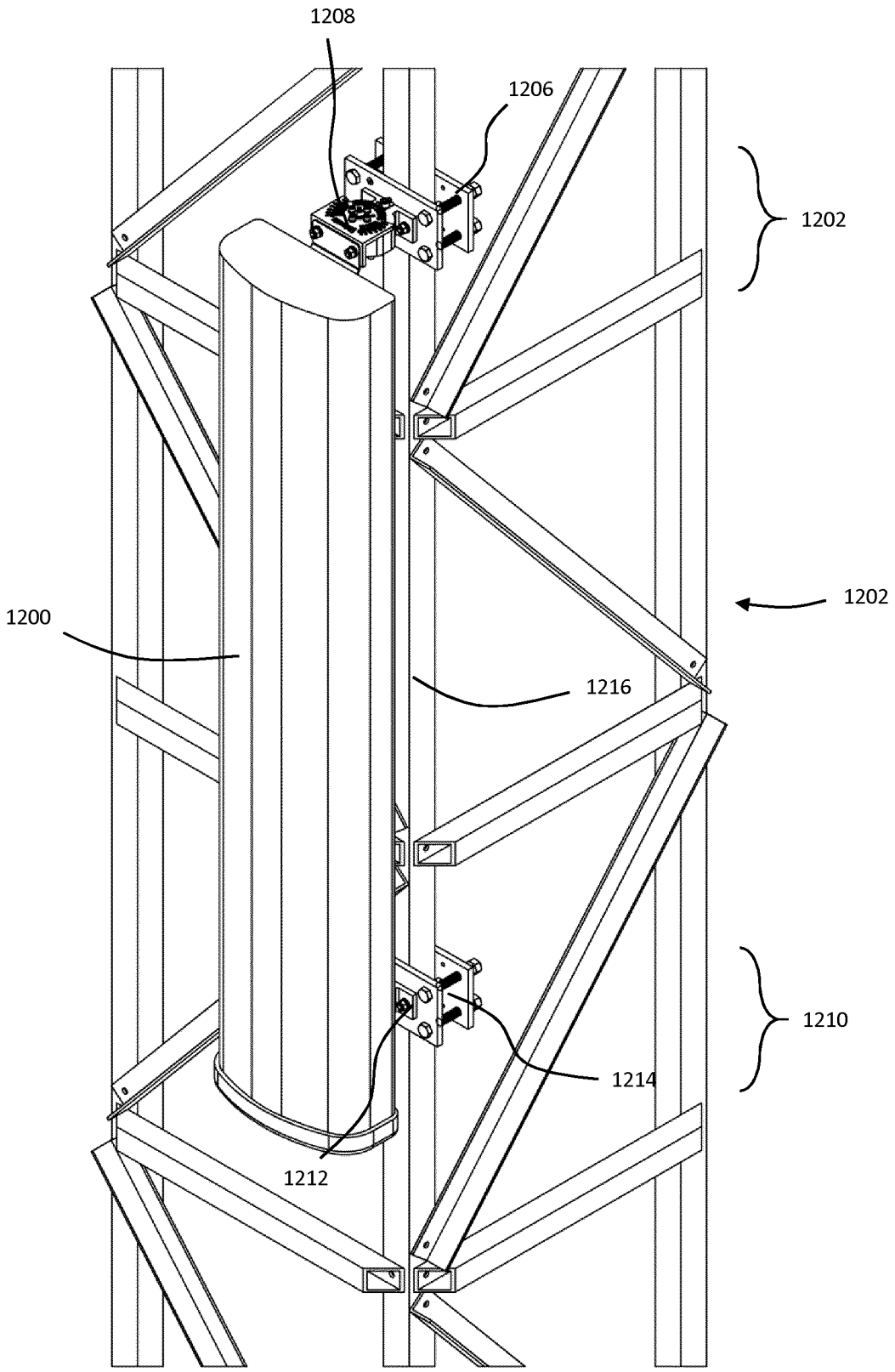
FIG. 38 is a perspective view of a cellular antenna attached to a mast using two of a second mounting assembly according to the present invention.
Figure 39:
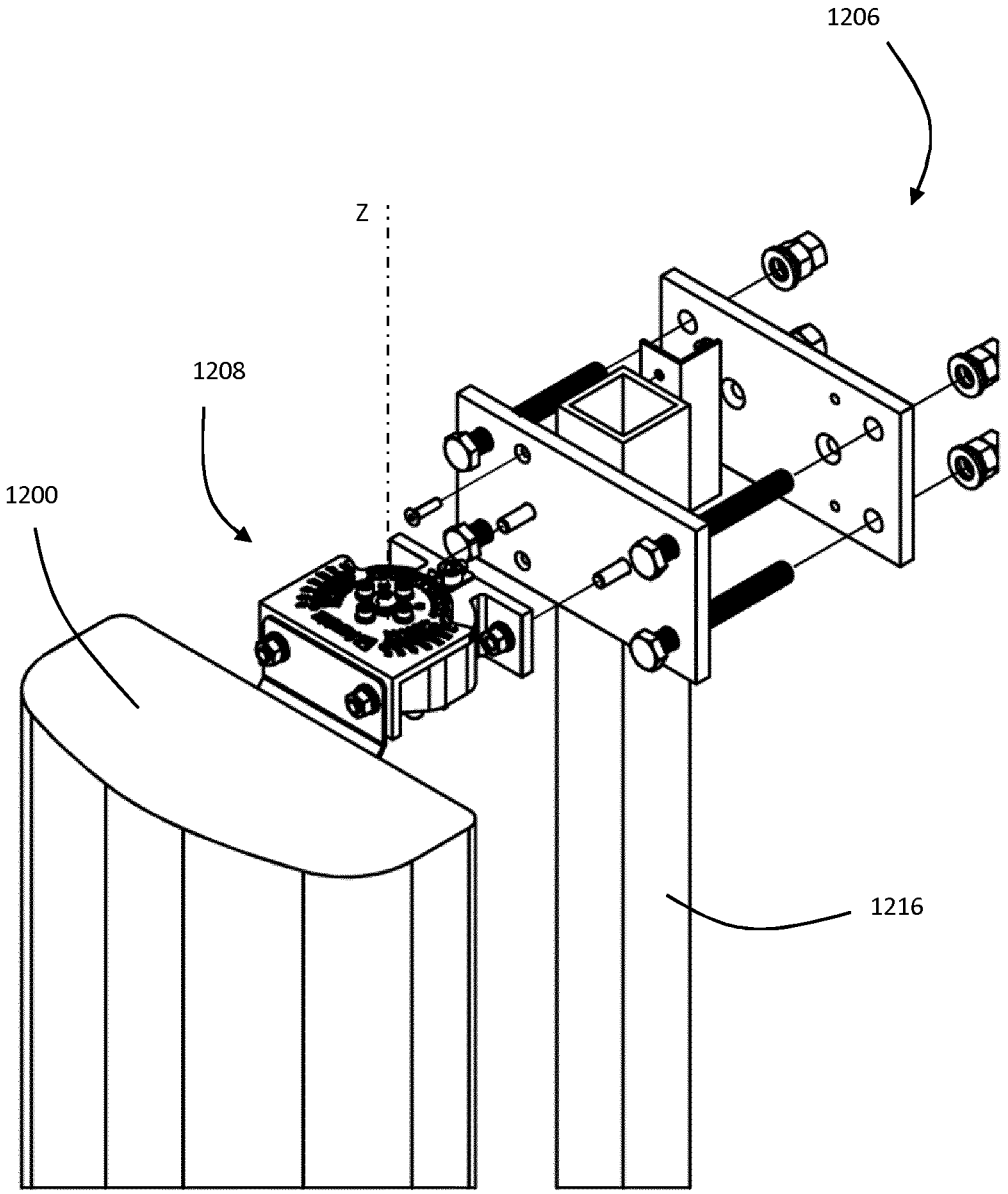
FIG. 39 is a detail, exploded view of a part of FIG. 38.

Referring to FIG. 38, an antenna 1200 is attached to a mast 1202 via a first mounting assembly 1204 comprising a first clamp 1206 and a first steering and locking apparatus 1208, and a second mounting assembly 1210 comprising a second clamp 1212 and a second steering and locking apparatus 1214.

Antenna

The antenna 1200 is identical to the antenna 1100.

Mast

The mast 1202 is also generally well-known in the art and comprises at least one upright or vertical member 1216 which is configured as a tubular square section. The vertical member 1216 is an integral, load-bearing part of the mast.

Clamps

The clamps 1206, 1212 are the main difference between the first and second embodiments. The clamps 1206, 1212 are identical, and as such only the clamp 1206 will be described with reference to FIGS. 40 and 41.

The clamp 1206 comprises a mounting member 1224, a clamp member 1226 and an angle bracket 1228.

The mounting member 1224 is a flat plate comprising four clamping bores 1230 at each corner. Two mounting bores 1232 are provided through the plate, being on the mast-side in use. Two angle bracket attachment bores 1233 are also provided through the plate. The angle bracket attachment bores 1233 are positioned on either side of one of the mounting bores 1232.

The clamp member 1226 is identical to the mounting member 1224.

The angle bracket 1228 is L-shaped in cross section comprising a first leg 1234 and a second leg 1236. The second leg 1236 has a pair of attachment bores 1238 defined therethrough.

Steering and Locking Apparatus

The steering and locking apparatus 1208, 1212 are identical to the steering and locking apparatuses 1108, 1112.

Installation

The first step is to attach one (or more) steering and locking apparatuses 1208 to the mounting member 1224. This is achieved by passing mechanical fasteners (bolts) from the mast side of the mounting member 1224, through the mounting bores 1230, and through aligned openings on the mounting flange of the steering and locking apparatus 1208. Nuts are used to fasten the steering and locking apparatus 1208 to the mounting member 1224.

The second step is to attach the angle bracket 1228 to the mounting member 1224. Bolts 1274 are passed through the bracket attachment bores 1233, through the attachment bores 1238 and secured with nuts 1276.

Figure 40:
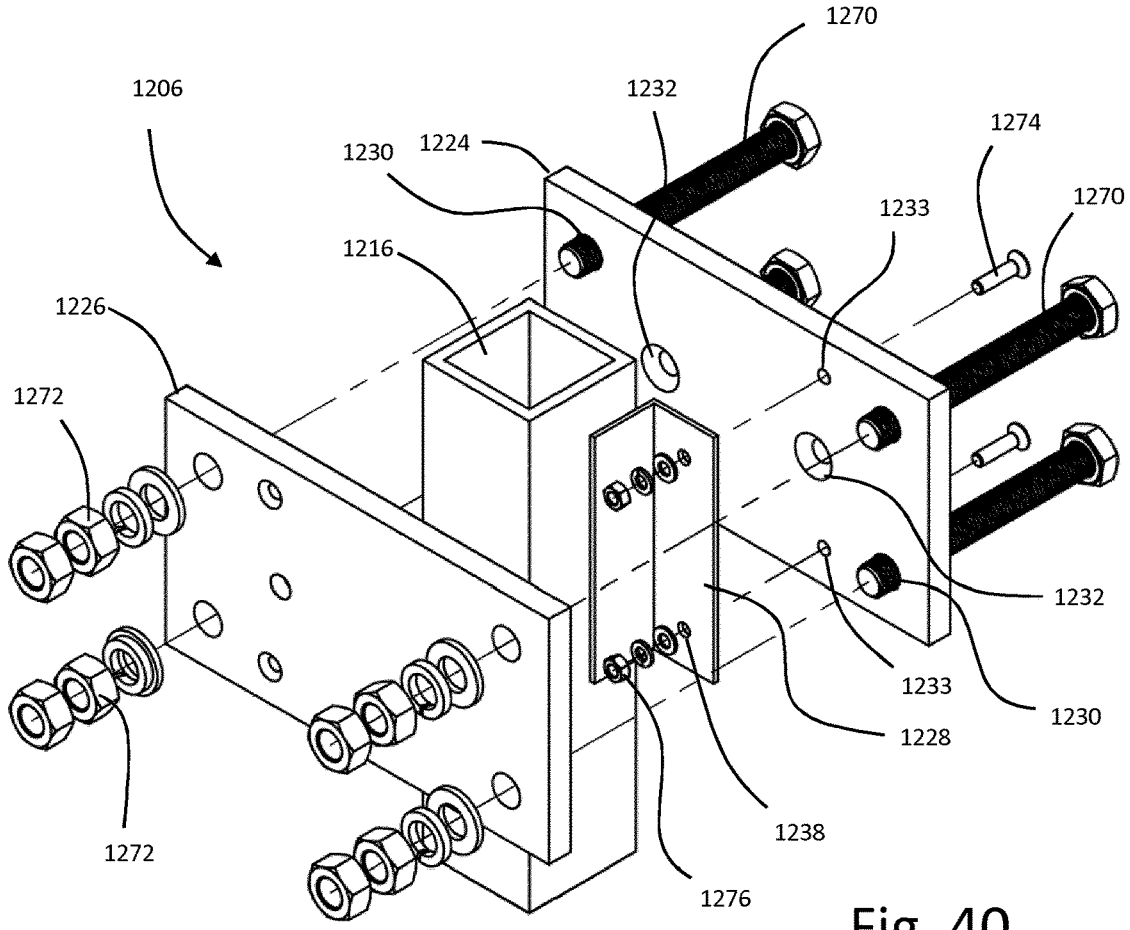
FIG. 40 is a detail, exploded view of a part of a mounting assembly of FIG. 38.
Figure 41:
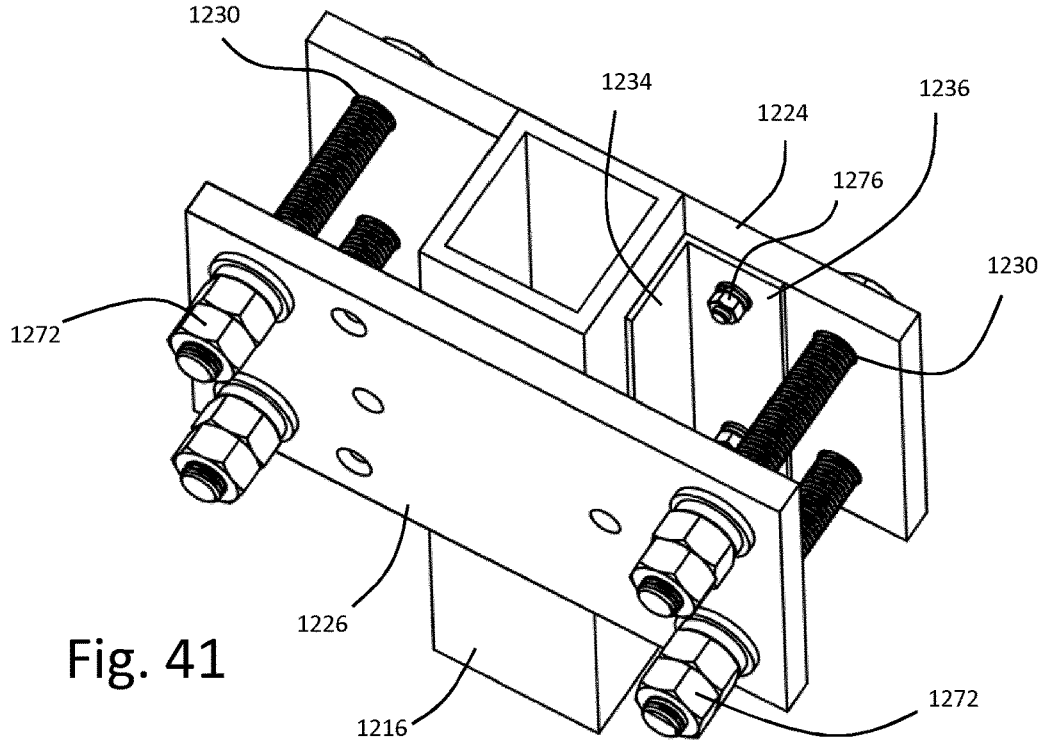
FIG. 41 is a detail view of a part of the mast and mounting assembly of FIG. 38.
Figure 42:
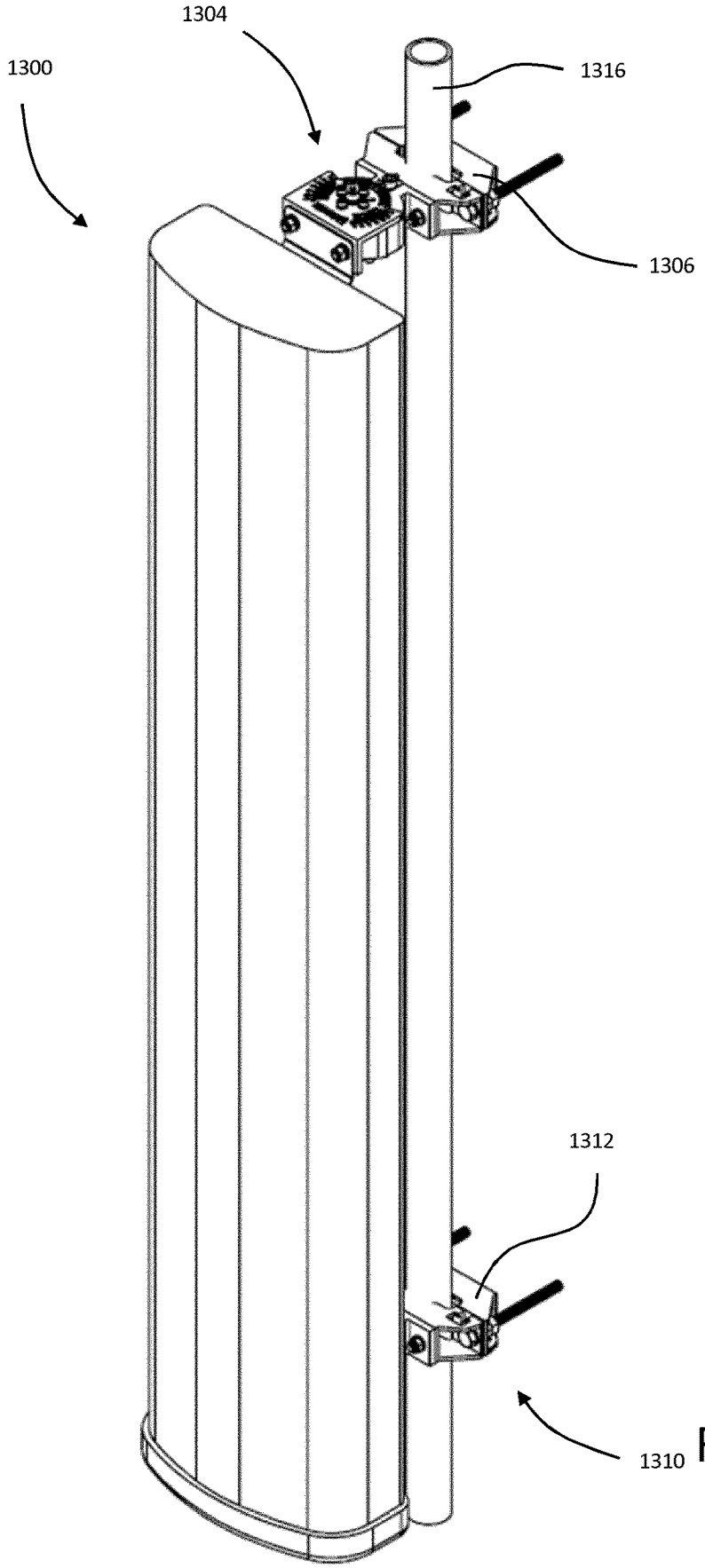
FIG. 42 is a perspective view of a cellular antenna attached to a mast using two of a third mounting assembly according to the present invention.

The third step is to attach the assembled steering and locking apparatus 1208 and mounting member 1224 to the mast 1202. This is achieved by clamping the mast member 1216 between the mounting member 1224 and the clamp member 1226 as shown in FIGS. 40 and 41 (the steering unit 1208 is not shown for clarity). Mechanical fasteners in the form of bolts 1270 are secured through the clamping bores 1230 of both the mounting member 1224 and clamp member 1226. Nuts 1272 are used to fasten the mounting member 1224 and clamp member 1226 together. As such, the mast member 1216 is clamped or sandwiched between the mounting member 1224 and the clamp member 1226.

The same process is repeated for the second steering unit 1214 and second clamp 1212, on the same mast member 1216 except axially offset from the first steering and locking apparatus 1208 and first clamp 1206.

The antenna 1200 is then mounted to the respective antenna mounting flanges of the steering and locking apparatuses 1208, 1212 as shown in FIG. 38.

Clamp 1306 (FIGS. 42 to 43) for Attachment to a Circle Section

Figure 43:
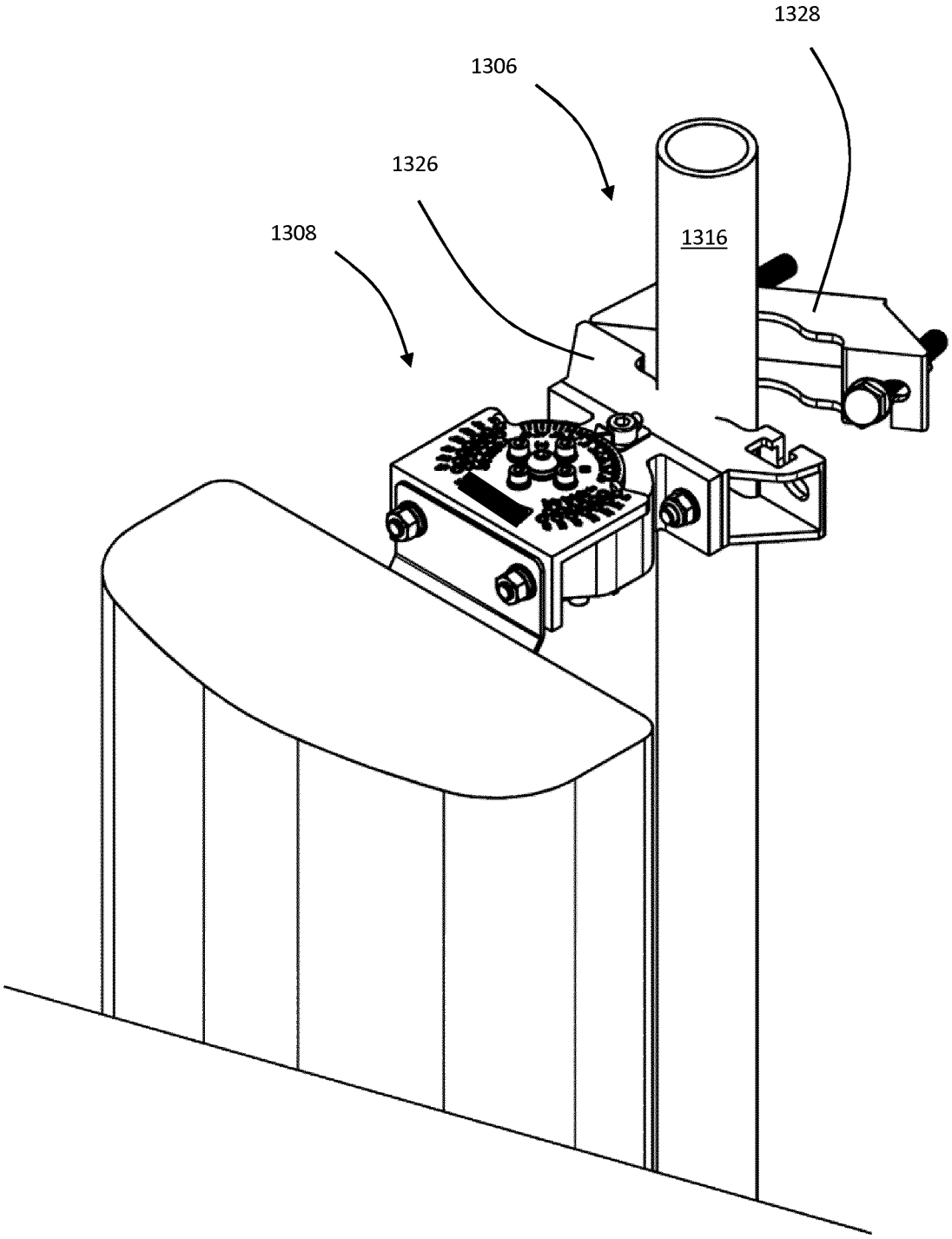
FIG. 43 is a detail view of a part of the mast and mounting assembly of FIG. 42.

Referring to FIG. 43, an antenna 1300 is attached to a mast via a first mounting assembly 1304 comprising a first clamp 1306 and a first steering and locking apparatus 1308, and a second mounting assembly 1310 comprising a second clamp 1312 and a second steering and locking apparatus (not visible).

Antenna

The antenna 1300 is identical to the antenna 1100.

Mast

The mast is generally well-known in the art and comprises at least one upright or vertical member 1316 which is configured as a tubular circle section.

Clamps

The clamps 1306, 1312 are the main difference between the second and third embodiments. The clamps 1306, 1312 are identical, and as such only the clamp 1306 will be described with reference to FIG. 43.

The clamp 1306 comprises a first clamp member 1326 and a second clamp member 1328. Each clamp member 1326, 1328 is identical, comprising a semi-circular concave pole receiving formation 1330 on one side. This enables the clamp members 1326, 1328 to be secured together to clamp the member 1316 therebetween.

The steering and locking apparatus 1308 is attached to the first clamp member 1326.

Figure 44:
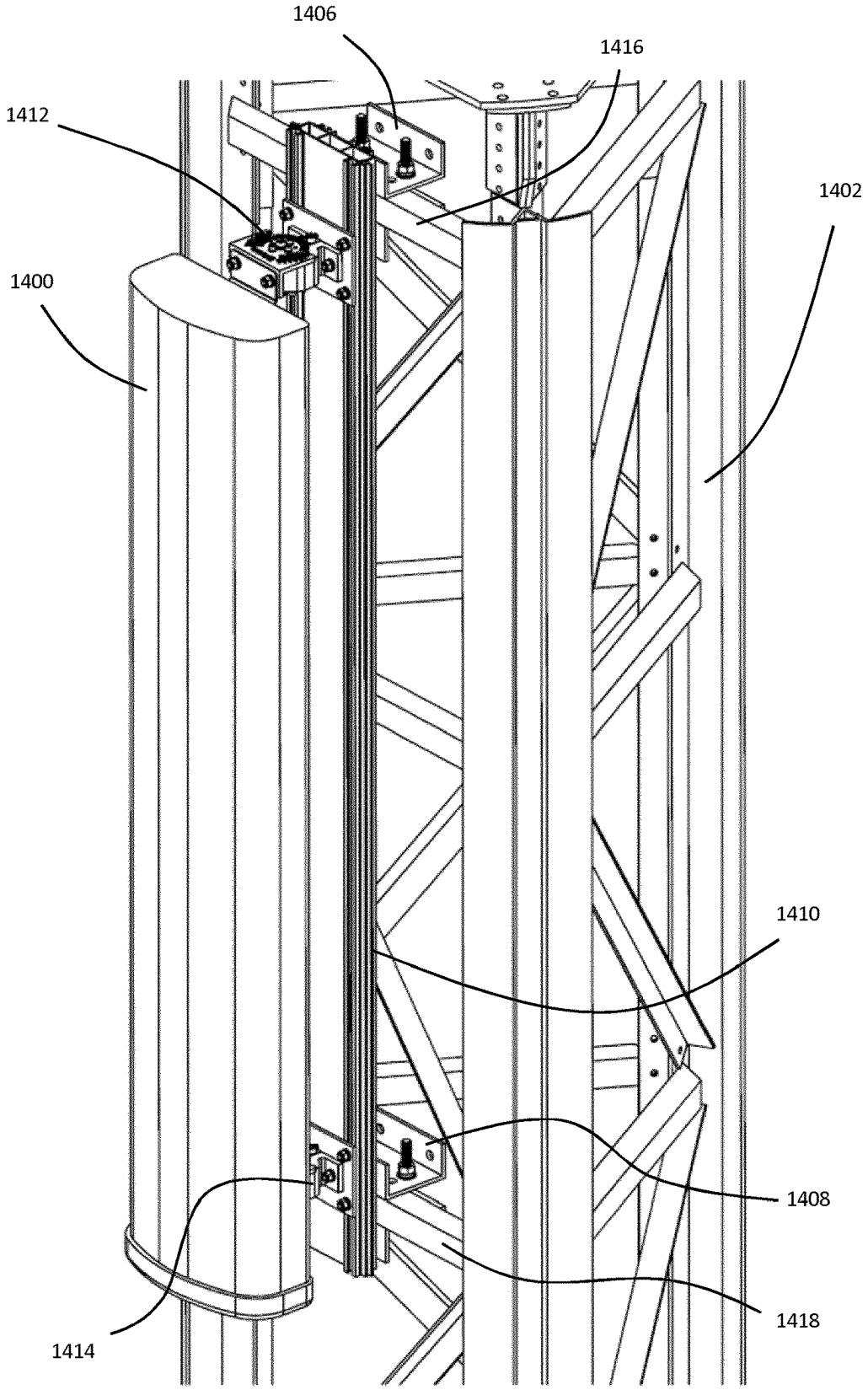
FIG. 44 is a perspective view of a cellular antenna attached to a mast using two of a fourth mounting assembly according to the present invention; and, FIG. 45 is a detail view of a part of the mast and mounting assembly of FIG. 44.

Clamp 1406 (FIGS. 44 to 45) for Attachment to a Horizontal Square Section Referring to FIG. 44, an antenna 1400 is attached to a mast 1402 via a first clamp 1406, a second clamp 1408, a backplate 1410, a first steering and locking apparatus 1412 and a second steering and locking apparatus 1414.

Antenna

The antenna 1400 is identical to the antenna 1100.

Mast

The mast 1402 is generally well-known in the art and comprises at least a first horizontal member 1416 and a second horizontal member 1418, both of which are configured as a tubular square section.

Clamps

Figure 45:
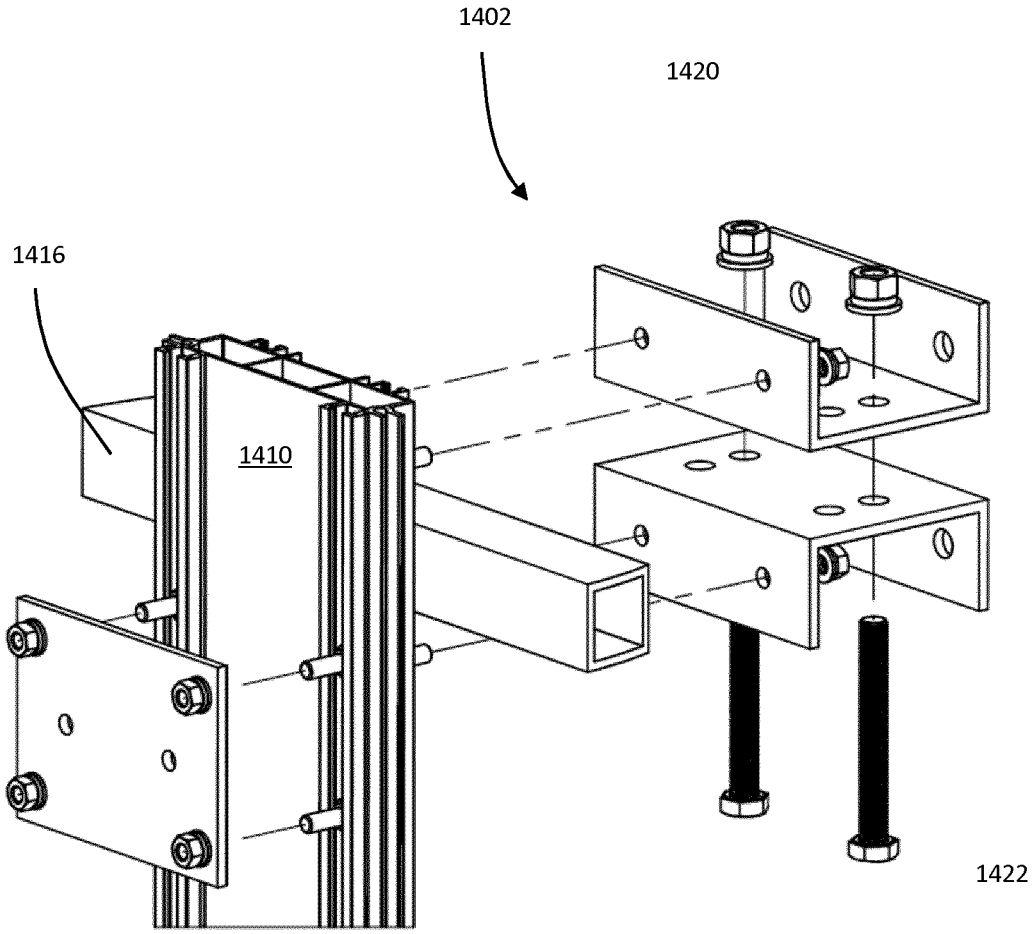

The clamps 1406, 1408 are are identical, and as such only the clamp 1406 will be described with reference to FIG. 45.

The clamp 1406 comprises a first U-shaped clamp member 1420, a second U-shaped clamp member 1422. The U-shaped clamp members 1420, 1422 are secured together either side (top and bottom) of the horizontal member 1416 with mechanical fasteners to clamp it therebetween.

Backplate

The backplate is an elongate, flat extruded component. Once both clamps 1406, 1408 are in place, the backplate 1410 is attached to them, and extends vertically between them.

Steering and Locking Apparatus

The steering and locking apparatus 1412, 1414 are identical to the steering and locking apparatuses 1108, 1112. They are attached to the backplate 1410 to allow steering and locking of the antenna 1400 as described above.

The clamping solutions improve the aerodynamics of the mast at tower top (where the antennas and antenna near products are installed), thus improving static performance of the whole mast structure.

The tower aerodynamic is improved as the effective surface area at tower top (where the antennas are located) is reduced since the antennas are moved closer to the mast structure without losing functionality (i.e. their azimuth steering capabilities).

Use of the clamps also reduces the antenna system weight at tower top.

It will be noted that the azimuth steering and locking apparatuses (top-bottom) need to be vertically aligned at the installation phase so as not to twist the antenna. Vertical alignment is achieved with the aforementioned clamps, since their azimuth mounting screw holes can be CNC machined with very low degrees of tolerance.

The invention claimed is:

1. A cellular antenna steering and locking apparatus comprising:

a first bracket for attachment to a fixed structure;

a second bracket for attachment to a cellular antenna;

a joint arrangement between the first and second brackets to facilitate rotation therebetween about a pivot axis; and a locking mechanism having:

a first toothed ratchet, a first ratchet-engaging member, the first ratchet-engaging member having a locked condition in which it is engaged with teeth of the first ratchet to lock the joint arrangement against rotation in a first rotational direction, and a first opposed ratchet-engaging member, the first opposed ratchet-engaging member having a locked condition in which it is engaged with either the teeth of the first ratchet or teeth of a second ratchet to lock the joint arrangement against rotation in a second rotational direction opposite to the first rotational direction.

2. A cellular antenna steering and locking apparatus according to claim 1, in which:

the first ratchet-engaging member is configured to lock the joint arrangement at a first set of predetermined angular positions of the joint arrangement; and, the locking mechanism comprises a second ratchet-engaging member, in which the second ratchet-engaging member has a locked condition in which it is engaged with the teeth of the first ratchet to lock the joint arrangement against rotation in at least the first rotational direction, and in which the second ratchet-engaging member is configured to lock the joint arrangement at a second set of predetermined angular positions interleaving the first set of predetermined angular positions.

3. A cellular antenna steering and locking apparatus according to claim 2, in which the second ratchet-engaging member is offset relative to the first.

4. A cellular antenna steering and locking apparatus according to claim 3, in which the second ratchet-engaging member is positioned at a rotational position of A1/2 degrees about the pivot axis compared to the first ratchet-engaging member, where A1 is the angular tooth spacing of the ratchet.

5. A cellular antenna steering and locking apparatus according to claim 2, in which the second ratchet-engaging member is shaped differently to the first so as to provide locking at the second set of predetermined angular positions.

6. A cellular antenna steering and locking apparatus according to claim 5, in which the first and second ratchet-engaging members are pivotable about a common axis, offset from the pivot axis.

7. A cellular antenna steering and locking apparatus according to claim 1, in which the first ratchet-engaging member and the first ratchet are configured to permit rotational movement in the second direction in the locked condition.

8. A cellular antenna steering and locking apparatus according to claim 1, in which the first opposed ratchet-engaging member and the first or second ratchet are configured to permit rotational movement in the first direction in the locked condition.

9. A cellular antenna steering and locking apparatus according to claim 1, in which the ratchet engaging member is moveable in a radial direction relative to the first ratchet.

10. A cellular antenna steering and locking apparatus according to claim 9, in which the ratchet engaging member comprises at least one elastically deformable member being elastically deformable between the locked and an unlocked condition.

11. A cellular antenna steering and locking apparatus according to claim 10, in which the ratchet engaging member comprises a plurality of elastically deformable members.

12. A cellular antenna steering and locking apparatus according to claim 11, in which the deformable members surround the first ratchet.

13. A cellular antenna steering and locking apparatus according to claim 12, comprising a collar surrounding the deformable members, in which axial movement of the collar deforms the members into the locked condition.

14. A cellular antenna steering and locking apparatus according to claim 13, in which at least one of the deformable members and the collar comprises a tapered surface to effect deformation of the at least one deformable member.

15. A method of steering and locking a cellular antenna comprising the steps of:

providing a steering and locking apparatus according to claim 1;

providing an antenna attached to the steering and locking apparatus;

moving the steering and locking apparatus to an unlocked condition;

rotating the antenna; and, moving the steering and locking apparatus into the locked condition to thereby lock the position of the antenna.

16. A cellular antenna locking mechanism according to claim 1, in which the second ratchet-engaging member is shaped differently to the first so as to provide locking at the second set of predetermined angular positions.

* * * * *